US011369149B2

(12) United States Patent
Fujinaga et al.

(10) Patent No.: US 11,369,149 B2
(45) Date of Patent: Jun. 28, 2022

(54) POWER SUPPLY UNIT FOR AEROSOL INHALER, AND AEROSOL INHALER

(71) Applicant: Japan Tobacco Inc., Tokyo (JP)

(72) Inventors: Ikuo Fujinaga, Tokyo (JP); Takuma Nakano, Tokyo (JP); Hajime Fujita, Tokyo (JP); Keiji Marubashi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 17/489,783

(22) Filed: Sep. 30, 2021

(65) Prior Publication Data

US 2022/0095689 A1 Mar. 31, 2022

(30) Foreign Application Priority Data

Sep. 30, 2020 (JP) ..... JP2020-166301

(51) Int. Cl.

| | |
|---|---|
| ***A24F 13/00*** | (2006.01) |
| ***A24F 40/53*** | (2020.01) |
| ***A24F 40/57*** | (2020.01) |
| ***A24F 40/30*** | (2020.01) |
| ***A24F 40/10*** | (2020.01) |

(Continued)

(52) U.S. Cl.

CPC ..... *A24F 40/53* (2020.01); *A24F 40/10* (2020.01); *A24F 40/30* (2020.01); *A24F 40/51* (2020.01); *A24F 40/57* (2020.01); *A24F 40/60* (2020.01)

(58) Field of Classification Search

CPC ..... A24F 47/00
USPC ..... 131/328–329
See application file for complete search history.

(56) References Cited

U.S. PATENT DOCUMENTS

| | | | | |
|---|---|---|---|---|
| 11,206,871 | B2 * | 12/2021 | Marubashi | A24F 40/57 |
| 2017/0071251 | A1 | 3/2017 | Goch | |
| 2020/0154766 | A1 | 5/2020 | Jeong | |

(Continued)

FOREIGN PATENT DOCUMENTS

| | | | |
|---|---|---|---|
| JP | 2016-525367 | A | 8/2016 |
| JP | 2017-511703 | A | 4/2017 |

(Continued)

OTHER PUBLICATIONS

Decision to Grant dated Jan. 12, 2020, received for JP Application 2020-166301, 5 pages including English Translation.

(Continued)

*Primary Examiner* — Phuong K Dinh
(74) *Attorney, Agent, or Firm* — Xsensus LLP

(57) ABSTRACT

A power supply unit for an aerosol inhaler, which causes an aerosol generated from an aerosol source to pass through a flavor source, includes: a power supply dischargeable to a first load configured to heat the aerosol source and dischargeable to a second load configured to heat the flavor source; a notification unit; a processing device; a circuit board; and a conductive portion configured to electrically connect the second load and the circuit board. The processing device is configured to detect adhesion of a liquid to the (Continued)

second load or entry of the liquid into the conductive portion. When the adhesion or the entry is detected, the processing device executes at least one of a notification action that causes the notification unit to execute a notification and a first fail-safe action including prevention of discharging from the power supply to the second load.

17 Claims, 18 Drawing Sheets

(51) Int. Cl.
*A24F 40/51* (2020.01)
*A24F 40/60* (2020.01)

(56) References Cited

U.S. PATENT DOCUMENTS

| | | | |
|---|---|---|---|
| 2020/0205478 | A1 | 7/2020 | Dick et al. |
| 2020/0352248 | A1 | 11/2020 | Yamada et al. |
| 2021/0015163 | A1 | 1/2021 | Mizuguchi et al. |
| 2021/0015164 | A1 | 1/2021 | Mizuguchi et al. |
| 2021/0015169 | A1 | 1/2021 | Mizuguchi et al. |
| 2021/0169148 | A1 | 6/2021 | Nakano et al. |
| 2021/0195961 | A1 | 7/2021 | Marubashi et al. |
| 2021/0401043 | A1* | 12/2021 | Mironov ..... H05B 3/26 |

FOREIGN PATENT DOCUMENTS

| | | | |
|---|---|---|---|
| JP | 2019-503668 | A | 2/2019 |
| JP | 6683865 | B1 | 3/2020 |
| JP | 6683866 | B1 | 3/2020 |
| JP | 2020-58308 | A | 4/2020 |
| JP | 6682031 | B1 | 4/2020 |
| JP | 2020-68688 | A | 5/2020 |
| WO | 2019/017654 | A2 | 1/2019 |
| WO | 2019/146062 | A1 | 8/2019 |
| WO | 2020/039589 | A1 | 2/2020 |
| WO | 2020/059049 | A1 | 3/2020 |

OTHER PUBLICATIONS

European Office Action dated Feb. 23, 2022, in European Application No. 21 199 814.1-1004.
European search report dated Feb. 11, 2022, in corresponding European patent Application No. 21199814.1, 4 pages.

* cited by examiner

POWER SUPPLY UNIT FOR AEROSOL INHALER, AND AEROSOL INHALER

CROSS-REFERENCE TO RELATED APPLICATIONS

This application claims priority to Japanese Patent Application No. 2020-166301 filed on Sep. 30, 2020, the content of which is incorporated herein by reference.

TECHNICAL FIELD

The present invention relates to a power supply unit for an aerosol inhaler and the aerosol inhaler.

BACKGROUND ART

JP 6682031 B disclose an aerosol inhaler that can add a flavor component contained in a flavor source to an aerosol by passing the aerosol generated by heating a liquid through the flavor source, and can cause a user to inhale the aerosol containing the flavor component.

An aerosol inhaler disclosed in WO 2020/039589, JP 2017-511703 T, and WO 2019/017654 includes a heater that heats a liquid for aerosol generation and a heater that heats a flavor source.

JP 6682031 B discloses that it is possible to detect electrolytic solution leakage of a power supply mounted on a power supply unit for the aerosol inhaler and submersion of the power supply unit.

As a result of intensive studies, the present inventors have found that in an aerosol inhaler including a heater that heats a liquid for aerosol generation and a heater that heats a flavor source, it may be desired to detect a liquid in addition to electrolytic solution leakage of a power supply and submersion of a power supply unit.

That is, in the aerosol inhaler including the heater that heats the liquid for aerosol generation and the heater that heats the flavor source, a liquid formed by aggregation of an aerosol may adhere to the heater that heats the flavor source or may enter a conductive portion that connects the heater and a circuit board. These events may reduce safety of the aerosol inhaler and flavor of the aerosol provided by the aerosol inhaler.

It is an object of the present invention to provide a power supply unit for an aerosol inhaler and an aerosol inhaler that can detect adhesion of a liquid formed by aggregation of an aerosol to a heater that heats a flavor source or entry of the liquid into a conductive portion.

SUMMARY OF INVENTION

According to an aspect of the present invention, there is provided a power supply unit for an aerosol inhaler that causes an aerosol generated from an aerosol source to pass through a flavor source to add a flavor component of the flavor source to the aerosol. The power supply unit includes: a power supply dischargeable to a first load configured to heat the aerosol source and dischargeable to a second load configured to heat the flavor source; a notification unit; a processing device; a circuit board on which the processing device is mounted; and a conductive portion configured to electrically connect the second load and the circuit board. The processing device is configured to detect adhesion of a liquid to the second load or entry of the liquid into the conductive portion. When the adhesion or the entry is detected, the processing device executes at least one of a notification action that causes the notification unit to execute a notification and a first fail-safe action including prevention of discharging from the power supply to the second load.

DESCRIPTION OF EMBODIMENTS

Hereinafter, an aerosol inhaler 1 according to embodiments of an aerosol inhaler of the present invention will be described with reference to the drawings.

First Embodiment (Aerosol Inhaler)

Figure 1:
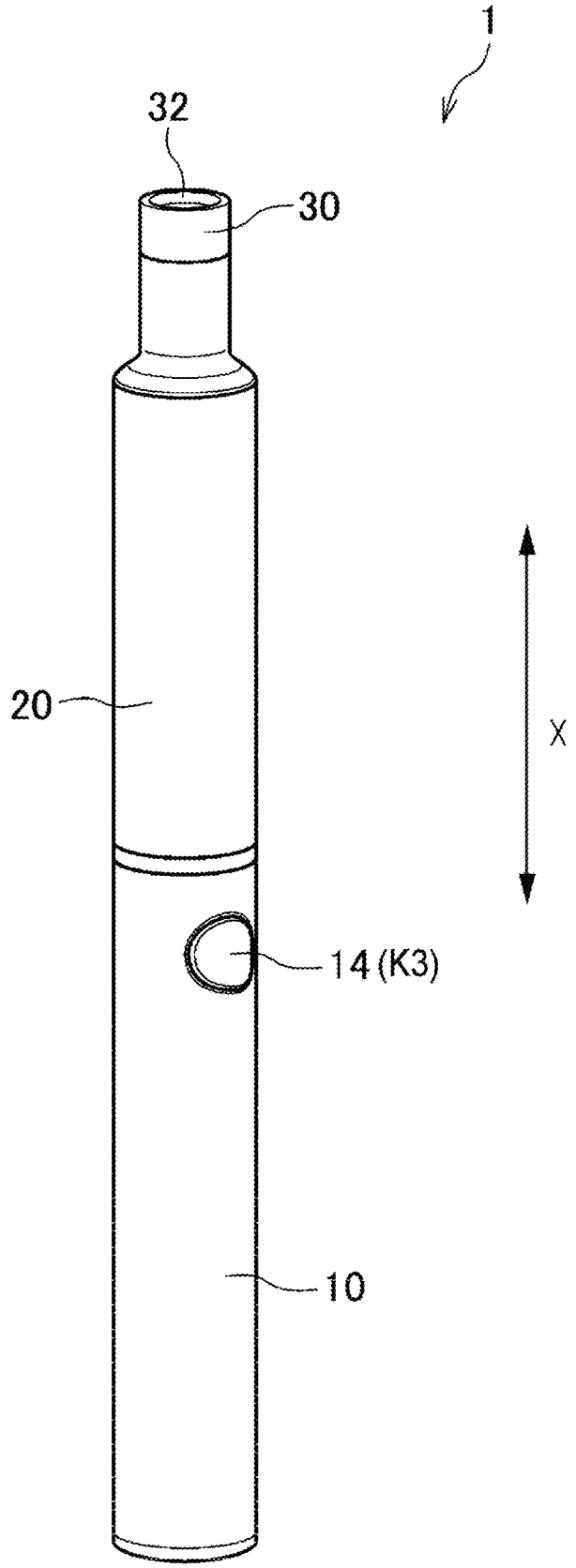
FIG. 1 is a perspective view schematically showing a schematic configuration of an aerosol inhaler according to a first embodiment.
Figure 2:
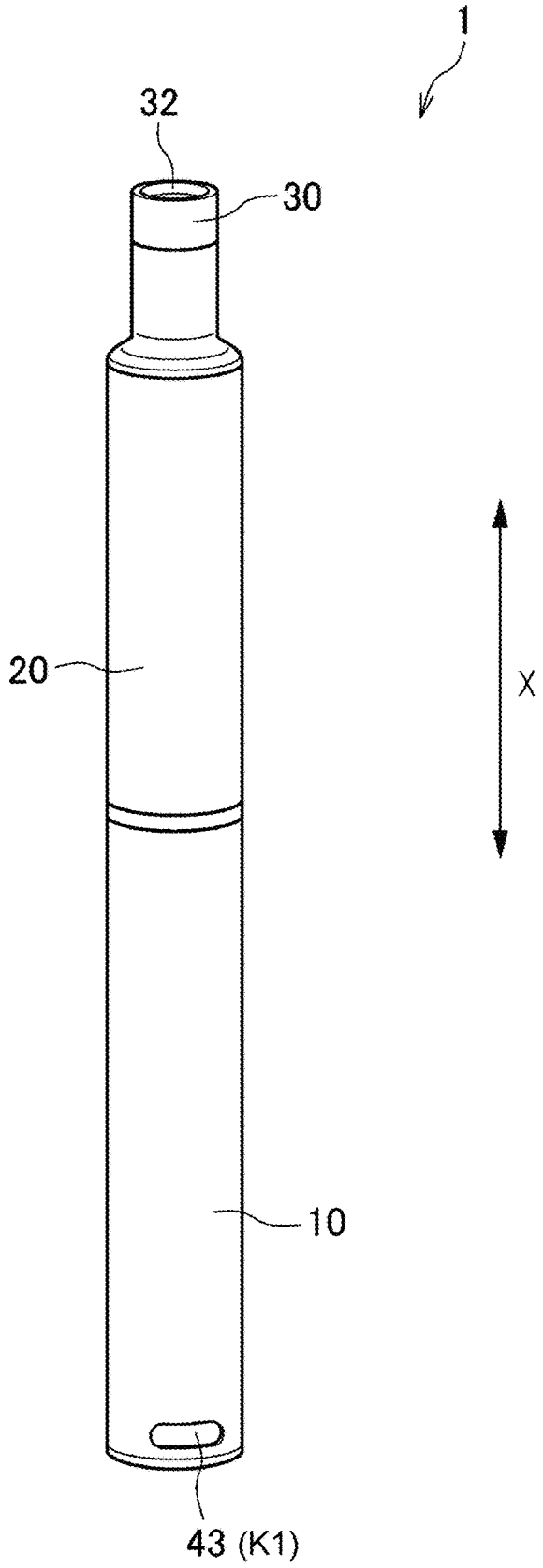
FIG. 2 is another perspective view of the aerosol inhaler of FIG. 1.
Figure 3:
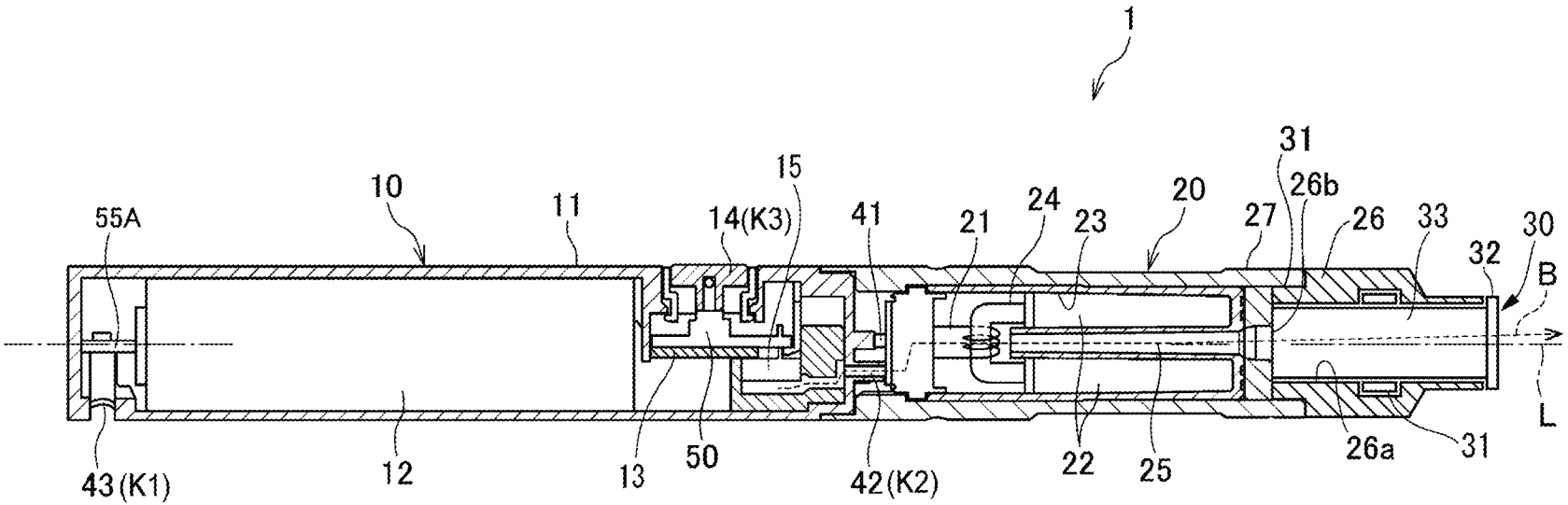
FIG. 3 is a cross-sectional view of the aerosol inhaler of FIG. 1.

The aerosol inhaler 1 is an instrument for generating an aerosol to which a flavor component is added without burning and allowing the aerosol to be inhaled, and has a rod shape that extends along a predetermined direction (hereinafter, referred to as a longitudinal direction X) as shown in FIGS. 1 and 2. In the aerosol inhaler 1, a power supply unit 10, a first cartridge 20, and a second cartridge 30 are provided in this order along the longitudinal direction X. The first cartridge 20 is attachable to and detachable from (in other words, replaceable with respect to) the power supply unit 10. The second cartridge 30 is attachable to and detachable from (in other words, replaceable with respect to)

the first cartridge 20. As shown in FIG. 3, the first cartridge 20 is provided with a first load 21 and a second load 31.

(Power Supply Unit)

As shown in FIGS. 3 to 6, the power supply unit 10 houses, inside a cylindrical power supply unit case 11, a power supply 12, a charging IC 55A, a micro controller unit (MCU) 50, a DC/DC converter 51, an intake sensor 15, a liquid sensor 16, a temperature detection element T1 including a voltage sensor 52 and a current sensor 53, a temperature detection element T2 including a voltage sensor 54 and a current sensor 55, and a circuit board 13 on which the DC/DC converter 51, the intake sensor 15, the liquid sensor 16, the temperature detection element T1, and the temperature detection element T2 are mounted. The number of the circuit boards 13 is not limited to one, and may be plural.

The power supply 12 is a rechargeable secondary battery, an electric double-layer capacitor, or the like, and is preferably a lithium-ion secondary battery. An electrolyte of the power supply 12 may be composed of one or a combination of a gel-like electrolyte, an electrolytic solution, a solid electrolyte, and an ionic liquid.

Figure 6:
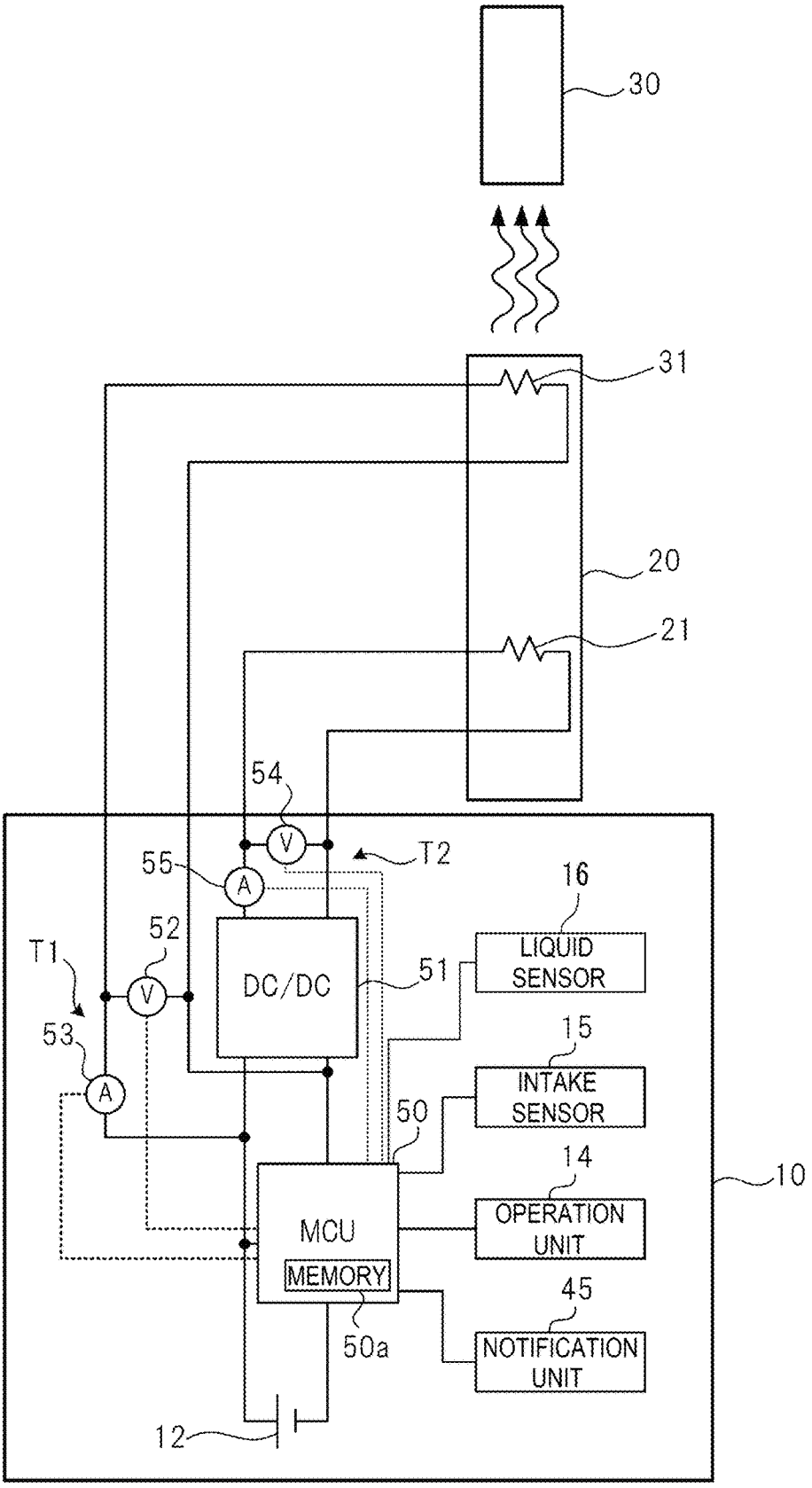
FIG. 6 is a schematic diagram showing a hardware configuration of the aerosol inhaler of FIG. 1.

As shown in FIG. 6, the MCU 50 is connected to various sensor devices such as the intake sensor 15, the liquid sensor 16, the voltage sensor 52, the current sensor 53, the voltage sensor 54, and the current sensor 55, the DC/DC converter 51, an operation unit 14, and a notification unit 45, and performs various controls of the aerosol inhaler 1.

Specifically, the MCU 50 is mainly configured with a processor, and further includes a memory 50*a* configured with a storage medium such as a random access memory (RAM) necessary for an operation of the processor and a read only memory (ROM) that stores various pieces of information. Specifically, the processor in the present description is an electric circuit in which circuit elements such as semiconductor elements are combined.

Figure 4:
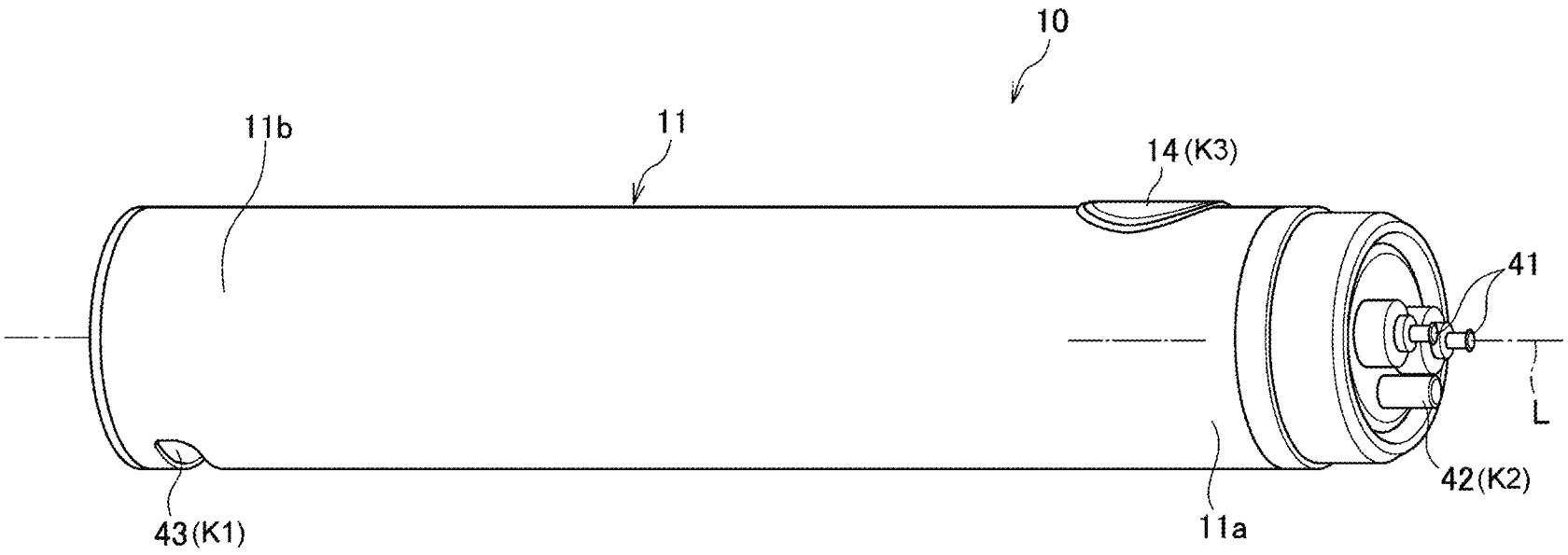
FIG. 4 is a perspective view of a power supply unit in the aerosol inhaler of FIG. 1.

As shown in FIG. 4, discharging terminals 41 are provided on a top portion 11*a* positioned on one end side of the power supply unit case 11 in the longitudinal direction X (a first cartridge 20 side). The discharging terminal 41 is provided so as to protrude from an upper surface of the top portion 11*a* toward the first cartridge 20, and can be electrically connected to the first load 21 and the second load 31 of the first cartridge 20.

On the upper surface of the top portion 11*a*, an air supply unit 42 that supplies air to the first load 21 of the first cartridge 20 is provided in the vicinity of the discharging terminals 41.

A charging terminal 43 that can be electrically connected to an external power supply (not shown) is provided in a bottom portion 11*b* positioned on the other end side of the power supply unit case 11 in the longitudinal direction X (a side opposite to the first cartridge 20). The charging terminal 43 is provided in a side surface of the bottom portion 11*b*, and can be connected to, for example, a universal serial bus (USB) terminal, a microUSB terminal, or the like.

The charging terminal 43 may be a power reception unit that can receive power transmitted from the external power supply in a wireless manner. In such a case, the charging terminal 43 (the power reception unit) may be configured with a power reception coil. A method for wireless power transfer may be an electromagnetic induction type or a magnetic resonance type. Further, the charging terminal 43 may be a power reception unit that can receive power transmitted from the external power supply in a contactless manner. As another example, the charging terminal 43 can be connected to a USB terminal, a microUSB terminal, or a Lightning terminal, and may include the power reception unit described above.

The power supply unit case 11 is provided with the operation unit 14 that can be operated by a user in the side surface of the top portion 11*a* so as to face a side opposite to the charging terminal 43. More specifically, the operation unit 14 and the charging terminal 43 have a point-symmetrical relationship with respect to an intersection between a straight line connecting the operation unit 14 and the charging terminal 43 and a center line of the power supply unit 10 in the longitudinal direction X. The operation unit 14 is configured with a button-type switch, a touch panel, or the like.

As shown in FIG. 3, the intake sensor 15 that detects a puff (inhale) operation is provided in the vicinity of the operation unit 14. The power supply unit case 11 is provided with an air intake port (not shown) that takes outside air into the power supply unit case 11. The air intake port may be provided around the operation unit 14 or may be provided around the charging terminal 43.

The intake sensor 15 is configured to output, as a value related to inhale of a user, a value of a pressure (internal pressure) change in the power supply unit 10 caused by the inhale of the user through an inhale port 32 described later. The intake sensor 15 is, for example, a pressure sensor that outputs an output value (for example, a voltage value or a current value) corresponding to an internal pressure that changes in accordance with a flow rate of air inhaled from an air intake port toward the inhale port 32 (that is, a puff operation of the user). The intake sensor 15 may output an analog value or may output a digital value converted from the analog value.

In order to compensate for a pressure to be detected, the intake sensor 15 may include a built-in temperature sensor that detects a temperature (an outside air temperature) of an environment in which the power supply unit 10 is placed. The intake sensor 15 may be configured with a condenser microphone or the like instead of a pressure sensor.

The liquid sensor 16 is a sensor for detecting adhesion of a liquid to the second load 31 or entry of the liquid into a conductive portion 71. The liquid sensor 16 may be an electrostatic capacitance sensor that outputs an electrostatic capacitance, or may be a sensor that outputs a value related to an electric resistance value. In the following description, a case where the liquid sensor 16 is an electrostatic capacitance sensor will be described unless otherwise specified.

When a puff operation is performed and an output value of the intake sensor 15 exceeds a threshold, the MCU 50 determines that an aerosol generation request has been made, and thereafter, when the output value of the intake sensor 15 is smaller than the threshold, the MCU 50 determines that the aerosol generation request has ended. In the aerosol inhaler 1, for a purpose of preventing overheating of the first load 21 or the like, when a period during which the aerosol generation request is made reaches a first default value $t_{upper}$ (for example, 2.4 seconds), it is determined that the aerosol generation request has ended regardless of the output value of the intake sensor 15. That is, the MCU 50 may determine that an aerosol generation request has ended and stop discharging to the first load 21 when any one of an elapse of a first default value $t_{upper}$ from a start of inhale or a start of discharging to the first load 21 and an end of the inhale is detected. Accordingly, an output value of the intake sensor 15 is used as a signal indicating an aerosol generation request. Therefore, the intake sensor 15 constitutes a sensor that outputs the aerosol generation request.

Instead of the intake sensor 15, the aerosol generation request may be detected based on an operation of the operation unit 14. For example, when the user performs a predetermined operation on the operation unit 14 in order to start inhaling an aerosol, the operation unit 14 may output the signal indicating the aerosol generation request to the MCU 50. In this case, the operation unit 14 constitutes a sensor that outputs the aerosol generation request.

The MCU 50 detects adhesion of a liquid formed by aggregation of an aerosol to the second load 31 or entry of the liquid into the conductive portion 71 based on an output of the liquid sensor 16. More specifically, when an output value of the liquid sensor 16 or a change in the output value exceeds a threshold, the MCU 50 determines that the liquid has adhered to the second load 31 or the liquid has entered the conductive portion 71, and executes a first fail-safe action. Details of the first fail-safe action will be described later.

The charging IC 55A is disposed close to the charging terminal 43, and controls charging of power input from the charging terminal 43 to the power supply 12. The charging IC 55A may be disposed in the vicinity of the MCU 50.

(First Cartridge)

As shown in FIG. 3, the first cartridge 20 includes, inside a cylindrical cartridge case 27, a reservoir 23 that stores an aerosol source 22, the first load 21 for atomizing the aerosol source 22, a wick 24 that draws the aerosol source from the reservoir 23 to the first load 21, the aerosol flow path 25 through which the aerosol generated by atomizing the aerosol source 22 flows toward the second cartridge 30, an end cap 26 that houses a part of the second cartridge 30, and the second load 31 that is provided in the end cap 26 and for heating the second cartridge 30.

The reservoir 23 is partitioned and formed so as to surround a periphery of the aerosol flow path 25 and stores the aerosol source 22. A porous body such as a resin web or cotton may be housed in the reservoir 23, and the porous body may be impregnated with the aerosol source 22. In the reservoir 23, the porous body on the resin web or the cotton may not be housed and only the aerosol source 22 may be stored. The aerosol source 22 contains a liquid such as glycerin, propylene glycol, or water.

The wick 24 is a liquid holding member that draws the aerosol source 22 from the reservoir 23 to the first load 21 by using a capillary phenomenon. The wick 24 is made of, for example, glass fiber or porous ceramic.

The first load 21 atomizes the aerosol source 22 by heating the aerosol source 22 without burning by power supplied from the power supply 12 via the discharging terminals 41. The first load 21 is configured with an electric heating wire (a coil) wound at a predetermined pitch.

The first load 21 may be an element that can generate the aerosol by heating the aerosol source 22 and atomizing the aerosol source 22. The first load 21 is, for example, a heat generation element. Examples of the heat generation element include a heat generation resistor, a ceramic heater, and an induction heating type heater.

As the first load 21, a load in which a temperature and an electric resistance value have a correlation is used. As the first load 21, for example, a load having positive temperature coefficient (PTC) characteristics in which an electric resistance value increases as a temperature increases is used.

The aerosol flow path 25 is provided on a downstream side of the first load 21 and on a center line L of the power supply unit 10. The end cap 26 includes a cartridge housing portion 26*a* that houses a part of the second cartridge 30, and a communication path 26*b* that communicates the aerosol flow path 25 and the cartridge housing portion 26*a*.

Figure 5:
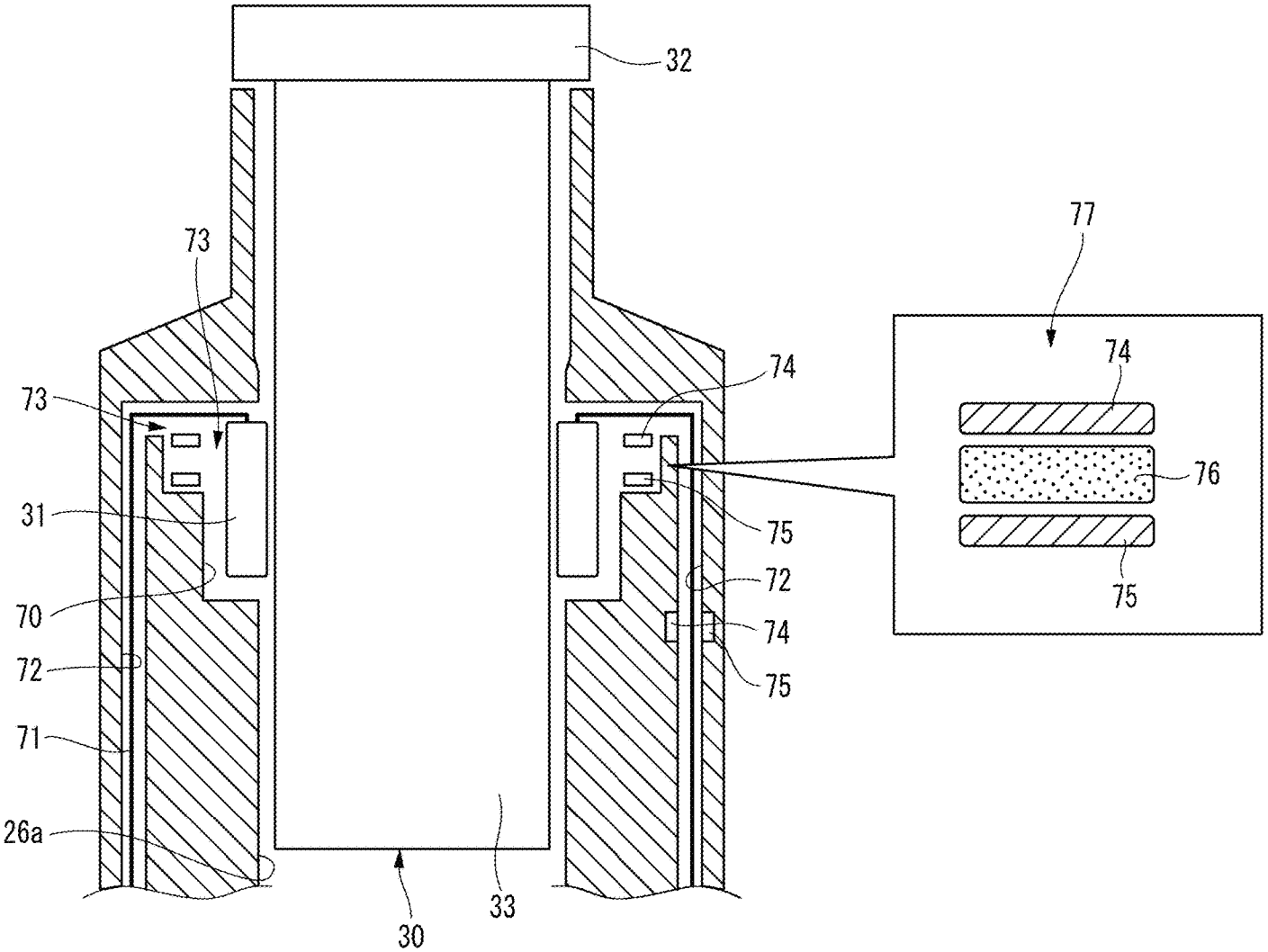
FIG. 5 is a partially enlarged view of FIG. 3.

As shown in FIG. 5, the second load 31 is embedded in a second load housing portion 70 disposed around a cartridge housing portion 26*a*. The second load 31 is connected to the power supply 12 via the discharging terminals 41 and the conductive portion 71 that extends inside the first cartridge 20 from the discharging terminals 41 to the second load 31, and heats the second cartridge 30 (more specifically, the flavor source 33 included therein) housed in the cartridge housing portion 26*a* by power supplied from the power supply 12. The second load 31 is configured with, for example, an electric heating wire (a coil) wound at a predetermined pitch. The conductive portion 71 is configured with, for example, a lead wire and a flexible circuit board.

The second load 31 may be an element that can heat the second cartridge 30. The second load 31 is, for example, a heat generation element. Examples of the heat generation element include a heat generation resistor, a ceramic heater, a stainless tube heater, and an induction heating type heater.

As the second load 31, a load in which a temperature and an electric resistance value have a correlation is used. As the second load 31, for example, a load having PTC characteristics is used.

In the vicinity of the second load 31, that is, in the second load housing portion 70, an auxiliary storage portion 73 that stores a liquid formed by aggregation of an aerosol is provided between the second load 31 and a conductive portion passage 72 through which the conductive portion 71 passes. A pair of facing metal plates 74 and 75 may be provided inside the auxiliary storage portion 73.

A porous body 76 that absorbs a liquid is preferably disposed between the pair of metal plates 74 and 75, and these constitute a capacitor 77. As the porous body 76, a cotton sheet, sponge, absorbent cotton, or the like can be used. The capacitor 77 may be a pseudo capacitor configured with the one metal plate 74 and a ground surface (for example, the cartridge case 27) having a GND potential, or may be a pseudo capacitor configured with the one metal plate 74, the ground surface, and the porous body 76 disposed between the one metal plate 74 and the ground surface, instead of being configured with the pair of facing metal plates 74 and 75. The capacitor 77 or the pseudo capacitor is connected to an electrostatic capacitance digital converter 56 described later, and a change in an electrostatic capacitance of the capacitor 77 or the pseudo capacitor is detected by the MCU 50 when the liquid enters between the pair of metal plates 74 and 75. As long as the MCU 50 can detect the change in the electrostatic capacitance caused by the entered liquid, a location where the pair of metal plates 74 and 75 or the one metal plate 74 and the ground surface are provided is not limited to an inside of the auxiliary storage portion 73. As a specific example, the pair of metal plates 74 and 75 or the one metal plate 74 and the ground surface may be provided at an end portion of the auxiliary storage portion 73 so as to sandwich the auxiliary storage portion 73, or may be provided in the vicinity of the auxiliary storage portion 73 slightly away from the end portion.

The capacitor 77 or the pseudo capacitor may be provided in the conductive portion passage 72, which is a space through which the conductive portion 71 passes in order to detect the entry of the liquid into the conductive portion 71, or may be provided so as to sandwich the conductive portion passage 72, instead of being provided in the auxiliary storage portion 73 in order to detect the adhesion of the liquid to the second load 31. Further, the capacitor 77 or the pseudo capacitor may be provided in the conductive portion passage 72 or may be provided so as to sandwich the conductive portion passage 72 together with the auxiliary storage portion 73. In such a case, the MCU 50 is preferably configured such that electrostatic capacitances of a plurality of capacitors 77 or pseudo capacitors can be distinguished and detected. Alternatively, by electrically connecting the plurality of capacitors 77 or the pseudo capacitors in parallel, the MCU 50 may detect the adhesion of the liquid or the entry of the liquid based on a sum of the electrostatic capacitances of the plurality of capacitors or the pseudo capacitors.

(Second Cartridge)

The second cartridge 30 stores the flavor source 33. When the second cartridge 30 is heated by the second load 31, the flavor source 33 is heated. The second cartridge 30 is detachably housed in the cartridge housing portion 26*a* provided in the end cap 26 of the first cartridge 20. In the second cartridge 30, an end portion on a side opposite to a first cartridge 20 side serves as the inhale port 32 of the user. The inhale port 32 is not limited to a case where it is integrally formed inseparably from the second cartridge 30, and may be configured to be detachable from the second cartridge 30. Accordingly, the inhale port 32 can be kept hygienic by configuring the inhale port 32 separately from the power supply unit 10 and the first cartridge 20.

The second cartridge 30 adds a flavor component to the aerosol by passing the aerosol generated by atomizing the aerosol source 22 by the first load 21 through the flavor source 33. As a raw material piece that constitutes the flavor source 33, it is possible to use chopped tobacco or a molded body obtained by molding a tobacco raw material into a granular shape. The flavor source 33 may be composed of a plant other than tobacco (for example, mint, Chinese herb, herb, or the like). A fragrance such as menthol may be added to the flavor source 33.

In the aerosol inhaler 1, the aerosol source 22 and the flavor source 33 can generate an aerosol to which a flavor component is added. That is, the aerosol source 22 and the flavor source 33 constitute an aerosol generation source that generates the aerosol.

The aerosol generation source of the aerosol inhaler 1 is a portion that is replaced and used by the user. The portion is provided to the user, for example, as a set of one first cartridge 20 and one or more (for example, five) second cartridges 30. Therefore, in the aerosol inhaler 1, a replacement frequency of the power supply unit 10 is the lowest, a replacement frequency of the first cartridge 20 is the next lowest, and a replacement frequency of the second cartridge 30 is the highest. Therefore, it is important to reduce manufacturing costs of the first cartridge 20 and the second cartridge 30. The first cartridge 20 and the second cartridge 30 may be integrated into one cartridge.

In the aerosol inhaler 1 configured as described above, as indicated by an arrow B in FIG. 3, air that flows in from the intake port (not shown) provided in the power supply unit case 11 passes through a vicinity of the first load 21 of the first cartridge 20 from the air supply unit 42. The first load 21 atomizes the aerosol source 22 drawn from the reservoir 23 by the wick 24. An aerosol generated by atomization flows through the aerosol flow path 25 together with the air that flows in from the intake port, and is supplied to the second cartridge 30 via the communication path 26*b*. The aerosol supplied to the second cartridge 30 passes through the flavor source 33 to add a flavor component and is supplied to the inhale port 32.

The aerosol inhaler 1 is provided with the notification unit 45 for notifying various pieces of information (see FIG. 6). The notification unit 45 may be configured with a light-emitting element, a vibration element, or a sound output element. The notification unit 45 may be a combination of two or more elements among the light-emitting element, the vibration element, and the sound output element. The notification unit 45 may be provided in any of the power supply unit 10, the first cartridge 20, and the second cartridge 30, but it is preferably provided in the power supply unit 10. For example, a configuration in which a periphery of the operation unit 14 has light-transmissive properties and light is emitted by a light-emitting element such as an LED is employed.

(Details of Power Supply Unit)

As shown in FIG. 6, the DC/DC converter 51 is connected between the first load 21 and the power supply 12 in a state where the first cartridge 20 is mounted on the power supply unit 10. The MCU 50 is connected between the DC/DC converter 51 and the power supply 12. The second load 31 is connected to a connection node between the MCU 50 and the DC/DC converter 51 in a state where the first cartridge 20 is mounted on the power supply unit 10. Accordingly, in the power supply unit 10, a series circuit of the DC/DC converter 51 and the first load 21 and the second load 31 are connected in parallel to the power supply 12 in a state where the first cartridge 20 is mounted.

The DC/DC converter 51 is a boosting circuit that can boost an input voltage, and is configured to be able to supply the input voltage or a voltage obtained by boosting the input voltage to the first load 21. Since power supplied to the first load 21 can be adjusted by the DC/DC converter 51, an amount of the aerosol source 22 atomized by the first load 21 can be controlled. As the DC/DC converter 51, for example, a switching regulator that converts an input voltage into a desired output voltage by controlling on/off time of a switching element while monitoring an output voltage can be used. When the switching regulator is used as the DC/DC converter 51, the input voltage can be output as it is without being boosted by controlling the switching element.

The processor of the MCU 50 is configured to be able to acquire a temperature of the flavor source 33 in order to control discharging to the second load 31 described later. Further, the processor of the MCU 50 is preferably configured to be able to acquire a temperature of the first load 21. The temperature of the first load 21 can be used to prevent overheating of the first load 21 and the aerosol source 22, and to highly control an amount of the aerosol source 22 atomized by the first load 21.

The voltage sensor 52 measures and outputs a value of a voltage applied to the second load 31. The current sensor 53 measures and outputs a value of a current that flows through the second load 31. An output of the voltage sensor 52 and an output of the current sensor 53 are input to the MCU 50. The processor of the MCU 50 acquires a resistance value of the second load 31 based on the output of the voltage sensor 52 and the output of the current sensor 53, and acquires the temperature of the second load 31 corresponding to the resistance value. The temperature of the second load 31 does not exactly coincide with the temperature of the flavor source 33 heated by the second load 31, but can be regarded as substantially the same as the temperature of the flavor source 33. Therefore, the temperature detection element T1 constitutes a temperature detection element for detecting the temperature of the flavor source 33.

If a constant current flows to the second load 31 when the resistance value of the second load 31 is acquired, the current sensor 53 is unnecessary in the temperature detection element T1. Similarly, if a constant voltage is applied to the second load 31 when the resistance value of the second load 31 is acquired, the voltage sensor 52 is unnecessary in the temperature detection element T1.

Instead of the temperature detection element T1, a temperature sensor for detecting the temperature of the second cartridge 30 may be provided in the first cartridge 20. The temperature sensor is configured with, for example, a thermistor disposed in the vicinity of the second cartridge 30. Since the temperature of the second cartridge 30 (flavor source 33) is acquired using the temperature sensor, it is possible to acquire the temperature of the flavor source 33 more accurately than acquiring the temperature of the flavor source 33 by using the temperature detection element T1.

The voltage sensor 54 measures and outputs a value of a voltage applied to the first load 21. The current sensor 55 measures and outputs a value of a current that flows through the first load 21. An output of the voltage sensor 54 and an output of the current sensor 55 are input to the MCU 50. The processor of the MCU 50 acquires a resistance value of the first load 21 based on the output of the voltage sensor 54 and the output of the current sensor 55, and acquires the temperature of the first load 21 corresponding to the resistance value. If a constant current flows to the first load 21 when the resistance value of the first load 21 is acquired, the current sensor 55 is unnecessary in the temperature detection element T2. Similarly, if a constant voltage is applied to the first load 21 when the resistance value of the first load 21 is acquired, the voltage sensor 54 is unnecessary in the temperature detection element T2.

Figure 7:
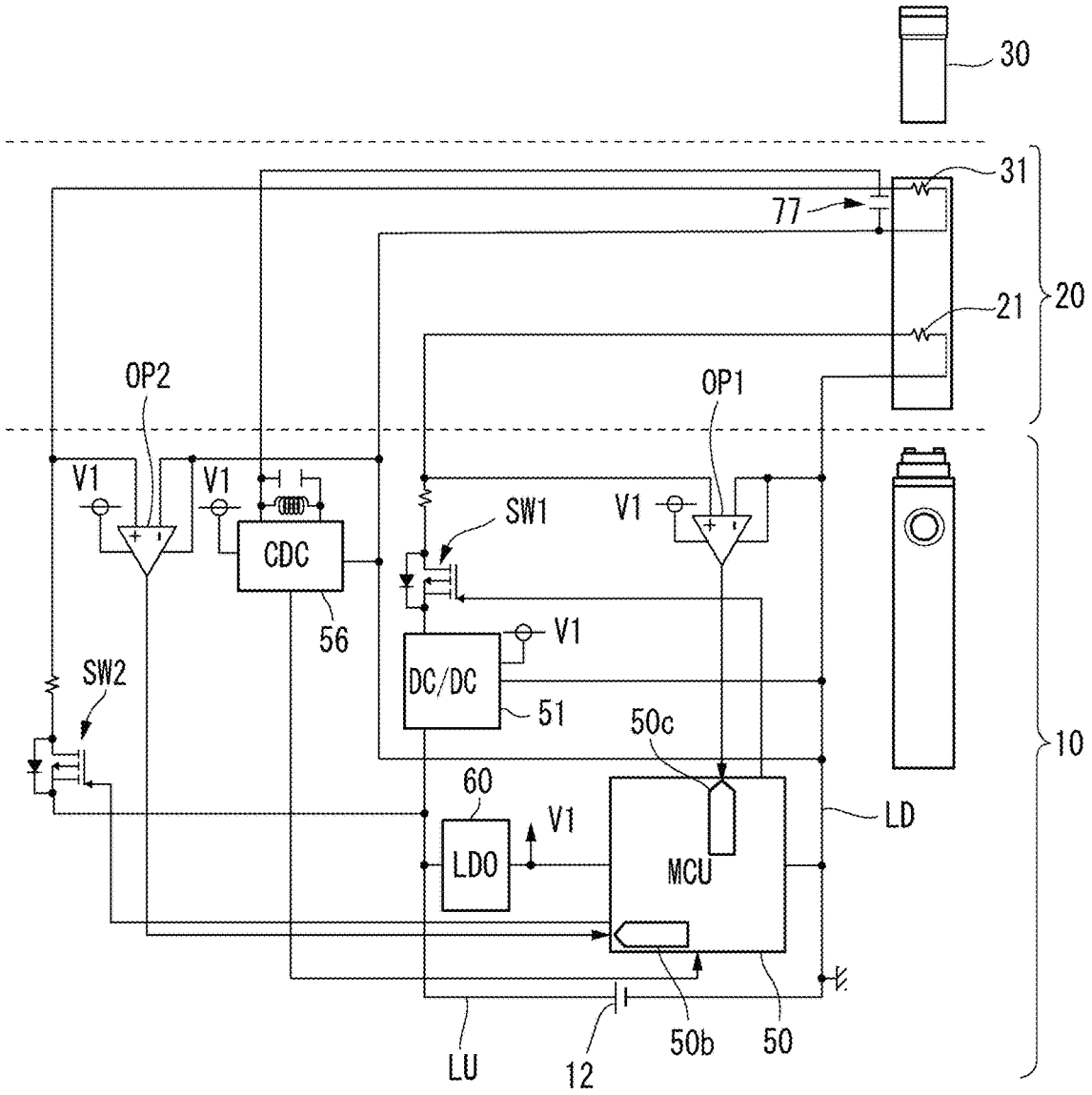
FIG. 7 is a diagram showing a specific example of the power supply unit shown in FIG. 6.

FIG. 7 is a diagram showing a specific example of the power supply unit 10 shown in FIG. 6. FIG. 7 shows a specific example of a configuration in which the temperature detection element T1 does not include the current sensor 53 and the temperature detection element T2 does not include the current sensor 55.

As shown in FIG. 7, the power supply unit 10 includes the power supply 12, the MCU 50, a low drop out (LDO) regulator 60, a switchgear SW1, a switchgear SW2, an operational amplifier OP1 and an analog-to-digital converter (hereinafter, referred to as ADC) 50*c* that constitute the voltage sensor 54, an operational amplifier OP2 and an ADC 50*b* that constitute the voltage sensor 52, and the electrostatic capacitance digital converter (hereinafter, referred to as CDC) 56 that constitutes the liquid sensor 16.

The switchgear described in the present description is a switching element such as a transistor that switches between disconnection and conduction of a wiring path. In an example of FIG. 7, the switchgears SW1 and SW2 are transistors, respectively.

The LDO regulator 60 is connected to a main positive bus LU connected to a positive electrode of the power supply 12. The MCU 50 is connected to the LDO regulator 60 and a main negative bus LD connected to a negative electrode of the power supply 12. The MCU 50 is also connected to the switchgears SW1 and SW2, and controls opening and closing of these switchgears. The MCU 50 is connected to the CDC 56 and detects a change in an electrostatic capacitance of the capacitor 77 or a pseudo capacitor. The LDO regulator 60 steps down a voltage from the power supply 12 and outputs the stepped-down voltage. An output voltage V1 of the LDO regulator 60 is also used as an operation voltage of each of the MCU 50, the DC/DC converter 51, the CDC 56, the operational amplifier OP1, and the operational amplifier OP2.

The DC/DC converter 51 is connected to the main positive bus LU. The first load 21 is connected to the main negative bus LD. The switchgear SW1 is connected between the DC/DC converter 51 and the first load 21.

The switchgear SW2 is connected between the second load 31 connected to the main negative bus LD and the main positive bus LU.

A non-inverting input terminal of the operational amplifier OP1 is connected to a connection node between the switchgear SW1 and the first load 21. An inverting input terminal of the operational amplifier OP1 is connected to the main negative bus LD.

A non-inverting input terminal of the operational amplifier OP2 is connected to a connection node between the switchgear SW2 and the second load 31. An inverting input terminal of the operational amplifier OP2 is connected to the main negative bus LD.

The ADC 50*c* is connected to an output terminal of the operational amplifier OP1. The ADC 50*b* is connected to an output terminal of the operational amplifier OP2. The ADC 50*c* and the ADC 50*b* may be provided outside the MCU 50.

The CDC 56 is connected to the capacitor 77 disposed in the vicinity of the second load 31. The CDC 56 uses an L-C resonator to output a digital value to the MCU 50 by using a change in a capacitance of the L-C resonator as a change in a resonance frequency. That is, the CDC 56 is a specific example of the liquid sensor 16 described above.

(MCU)

Next, a function of the MCU 50 will be described. The MCU 50 includes a temperature detection unit, a power control unit, a liquid detection unit, and a notification control unit as functional blocks implemented by the processor executing a program stored in the ROM.

The temperature detection unit acquires the temperature of the flavor source 33 based on an output of the temperature detection element T1. Further, the temperature detection unit acquires the temperature of the first load 21 based on an output of the temperature detection element T2.

In a case of a circuit example shown in FIG. 7, in a state where the switchgear SW2 is controlled to be in a disconnected state and the switchgear SW1 is controlled to be in a conduction state, the temperature detection unit acquires an output value of the ADC 50*c* (a value of a voltage applied to the first load 21), and acquires the temperature of the first load 21 based on the output value. Further, in a state where the switchgear SW1 is controlled to be in a disconnected state and the switchgear SW2 is controlled to be in a conductive state, the temperature detection unit acquires an output value (a value of a voltage applied to the second load 31) of the ADC 50*b*, and acquires the temperature of the second load 31 as the temperature of the flavor source 33 based on the output value.

The notification control unit controls the notification unit 45 so as to notify various pieces of information. For example, in response to detection of a replacement timing of the second cartridge 30, the notification control unit controls the notification unit 45 to perform a notification prompting replacement of the second cartridge 30. The notification control unit is not limited to the notification prompting the replacement of the second cartridge 30, but may cause a notification prompting a replacement of the first cartridge 20, a notification prompting a replacement of the power supply 12, a notification prompting charging of the power supply 12, and the like to be performed. Further, when the adhesion of the liquid to the second load 31 or the entry of the liquid into the conductive portion 71 is detected, the notification control unit controls the notification unit 45 to notify an occurrence of an abnormality.

The power control unit controls discharging from the power supply 12 to the first load 21 and the second load 31 (discharging necessary for heating the load) in response to a signal indicating the aerosol generation request output from the intake sensor 15.

In the aerosol inhaler 1, the flavor source 33 can be heated by discharging to the second load 31. In order to increase an amount of a flavor component added to the aerosol, it is experimentally found that it is effective to increase an amount of an aerosol generated from the aerosol source 22 and to increase the temperature of the flavor source 33.

Therefore, the power control unit controls discharging for heating the first load 21 and the second load 31 from the power supply 12 such that a unit flavor amount (an amount of a flavor component $W_{flavor}$ described below), which is an amount of a flavor component added to an aerosol generated for each aerosol generation request, converges to a target amount based on information on the temperature of the flavor source 33. The target amount is an appropriately determined value. For example, a target range of the unit flavor amount may be appropriately determined, and a median value in the target range may be set as the target amount. Accordingly, by causing the unit flavor amount (the amount of the flavor component $W_{flavor}$) to converge to the target amount, it is also possible to cause the unit flavor amount to converge to a target range having a certain width. A weight may be used as a unit of the unit flavor amount, the amount of the flavor component $W_{flavor}$, and the target amount.

The power control unit controls discharging for heating from the power supply 12 to the second load 31 such that the temperature of the flavor source 33 converges to a target temperature (a target temperature $T_{cap_target}$ described below) based on the output of the temperature detection element T1 that outputs the information on the temperature of the flavor source 33.

(Various Parameters Used for Aerosol Generation)

Hereinafter, various parameters and the like used for discharging control for aerosol generation will be described before moving on to description of a specific operation of the MCU 50.

A weight [mg] of an aerosol that is generated in the first cartridge 20 and passes through the flavor source 33 by one inhale operation by the user is referred to as an aerosol weight $W_{aerosol}$. Power required to be supplied to the first load 21 for generating the aerosol is referred to as atomization power $P_{liquid}$. When it is assumed that the aerosol source 22 is sufficiently present, the aerosol weight $W_{aerosol}$ is proportional to the atomization power $P_{liquid}$ and the supply time $t_{sense}$ of the atomization power $P_{liquid}$ to the first load 21 (in other words, an energization time to the first load 21 or a time during which a puff is performed). Therefore, the aerosol weight $W_{aerosol}$ can be modeled by the following Equation (1). α in Equation (1) is a coefficient obtained experimentally. An upper limit of the supply time $t_{sense}$ is the first default value $t_{upper}$ described above. Further, the following Equation (1) may be replaced with Equation (1A). In Equation (1A), an intercept b having a positive value is introduced into Equation (1). This is a term that can be optionally introduced in consideration of a fact that a part of the atomization power $P_{liquid}$ is used for increasing a temperature of the aerosol source 22 that occurs before atomization in the aerosol source 22. The intercept b can also be obtained experimentally.

$$W_{aerosol}=\alpha\times P_{liquid}\times t_{sense} \tag{1}$$

$$W_{aerosol}=\alpha\times P_{liquid}\times t_{sense}-b \tag{1A}$$

A weight [mg] of a flavor component contained in the flavor source 33 in a state where inhale is performed $n_{puff}$ times ($n_{puff}$ is a natural number of 0 or more) is referred to as a flavor component remaining amount $W_{capsule}$ ($n_{puff}$). A remaining amount of a flavor component ($W_{capsule}$ ($n_{puff}$=0)) contained in the flavor source 33 of the second cartridge 30 in a new product state is also referred to as $W_{initial}$. The information on the temperature of the flavor source 33 is referred to as a capsule temperature parameter $T_{capsule}$. A weight [mg] of a flavor component added to an aerosol that passes through the flavor source 33 by one inhale operation by the user is referred to as an amount of a flavor component $W_{flavor}$. The information on the temperature of the flavor source 33 is, for example, the temperature of the flavor source 33 or the temperature of the second load 31 acquired based on the output of the temperature detection element T1.

It is experimentally found that the amount of the flavor component $W_{flavor}$ depends on the flavor component remaining amount $W_{capsule}$ ($n_{puff}$), the capsule temperature parameter $T_{capsule}$, and the aerosol weight $W_{aerosol}$. Therefore, the amount of the flavor component $W_{flavor}$ can be modeled by the following Equation (2).

$$W_{flavor}=\beta\times\{W_{capsule}(n_{puff})\times T_{capsule}\}\times\gamma\times W_{aerosol} \tag{2}$$

Every time one inhale is performed, the flavor component remaining amount $W_{capsule}$ ($n_{puff}$) decreases by the amount of the flavor component $W_{flavor}$. Therefore, the flavor component remaining amount $W_{capsule}$ ($n_{puff}$) can be modeled by the following Equation (3).

$$W_{capsule}(n_{puff}) = W_{initial} - \delta\cdot\sum_{i=1}^{n_{puff}} W_{flavor}(i) \tag{3}$$

β in Equation (2) is a coefficient indicating a ratio of how much of the flavor component contained in the flavor source 33 is added to an aerosol in one inhale, and is obtained experimentally. γ in Equation (2) and δ in Equation (3) are coefficients obtained experimentally, respectively. The capsule temperature parameter $T_{capsule}$ and the flavor component remaining amount $W_{capsule}$ ($n_{puff}$) may fluctuate during a period during which one inhale is performed, but in the model, γ and δ are introduced in order to treat the capsule temperature parameter $T_{capsule}$ and the flavor component remaining amount $W_{capsule}$ ($n_{puff}$) as constant values.

(Operation of Aerosol Inhaler)

Figure 9:
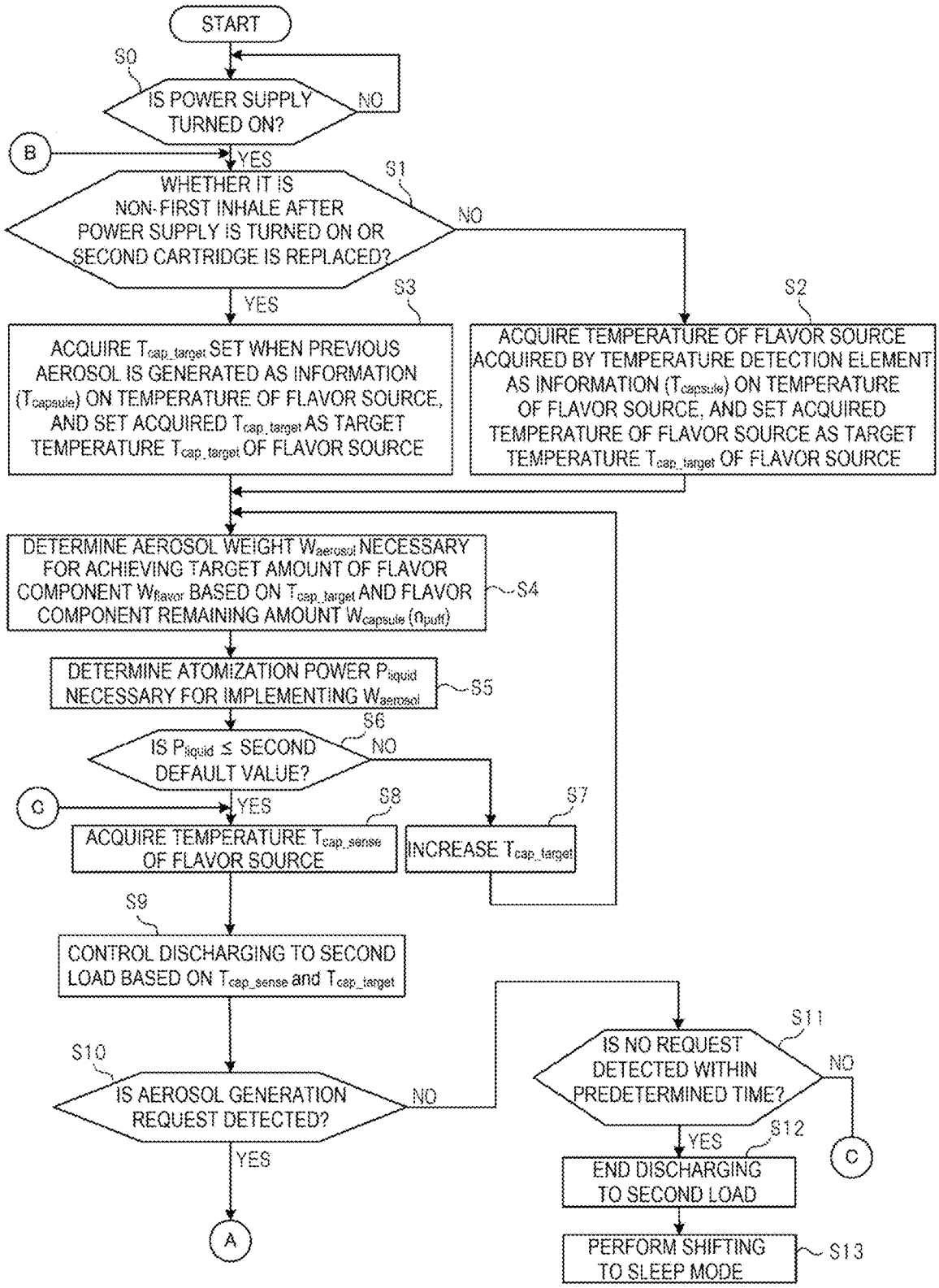
FIG. 9 is a flowchart for illustrating an operation of the aerosol inhaler of FIG. 1.
Figure 10:
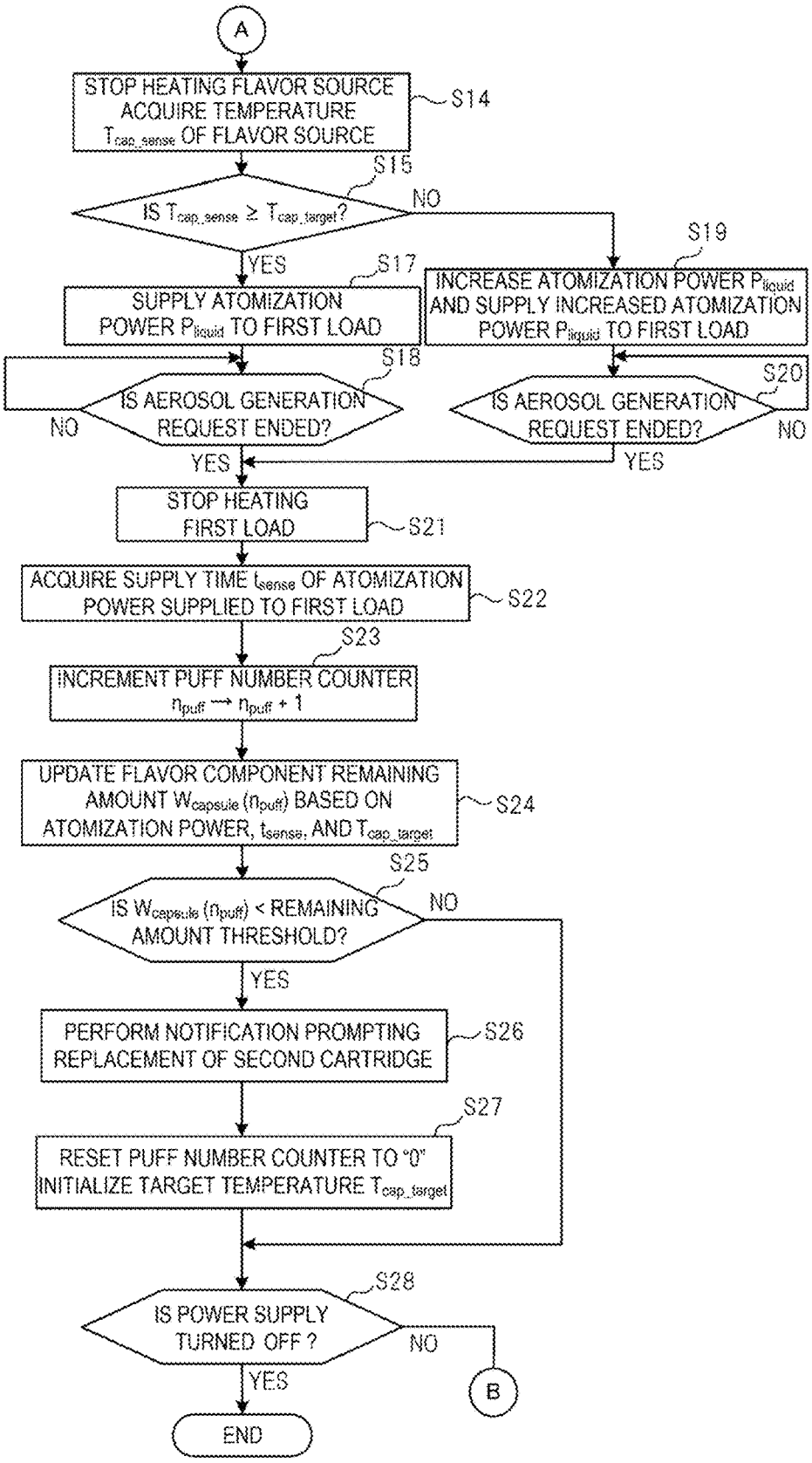
FIG. 10 is a flowchart for illustrating the operation of the aerosol inhaler of FIG. 1.

FIGS. 9 and 10 are flowcharts for illustrating an operation of the aerosol inhaler 1 of FIG. 1. When the power supply of the aerosol inhaler 1 is turned on by an operation of the operation unit 14 or the like (step S0: YES), the MCU 50 determines whether an aerosol has been generated (whether inhale by the user has been performed even once) after the power supply is turned on or after the second cartridge 30 is replaced (step S1).

For example, the MCU 50 includes a built-in puff number counter that counts up the $n_{puff}$ from an initial value (for example, 0) every time inhale (an aerosol generation request) is performed. A count value of the puff number counter is stored in the memory 50*a*. The MCU 50 determines whether a state is after the inhale has been performed even once by referring to the count value.

When it is a timing before a first inhale after the power supply is turned on or before a first inhale after the second cartridge 30 is replaced (step S1: NO), heating of the flavor source 33 is not yet performed or heating is not performed for a while, and the temperature of the flavor source 33 is highly likely to depend on an external environment. Therefore, in this case, the MCU 50 acquires the temperature of the flavor source 33 acquired based on the output of the temperature detection element T1 as the capsule temperature parameter $T_{capsule}$, sets the acquired temperature of the flavor source 33 as a target temperature $T_{cap_target}$ of the flavor source 33, and stores the temperature of the flavor source 33 in the memory 50*a* (step S2).

In a state where the determination in step S1 is NO, it is highly possible that the temperature of the flavor source 33 is close to an outside air temperature or a temperature of the power supply unit 10. Therefore, in step S2, as a modification, the outside air temperature or the temperature of the power supply unit 10 may be acquired as the capsule temperature parameter $T_{capsule}$, and may be set as the target temperature $T_{cap_target}$.

The outside air temperature is preferably acquired from, for example, a temperature sensor built in the intake sensor 15. The temperature of the power supply unit 10 is preferably acquired from, for example, a temperature sensor built in the MCU 50 in order to manage a temperature inside the MCU 50. In this case, both the temperature sensor built in the intake sensor 15 and the temperature sensor built in the MCU 50 function as elements that output the information on the temperature of the flavor source 33.

In the aerosol inhaler 1, as described above, the discharging from the power supply 12 to the second load 31 is controlled such that the temperature of the flavor source 33 converges to the target temperature $T_{cap_target}$. Therefore, it is highly possible that the temperature of the flavor source 33 is close to the target temperature $T_{cap_target}$ after inhale is performed even once after the power supply is turned on or the second cartridge 30 is replaced. Therefore, in this case (step S1: YES), the MCU 50 acquires the target temperature $T_{cap_target}$ stored in the memory 50*a* and used for the previous aerosol generation as the capsule temperature parameter $T_{capsule}$, and sets the target temperature $T_{cap_target}$ stored in the memory 50*a* and used for the previous aerosol generation as it is as the target temperature $T_{cap_target}$ (step S3). In this case, the memory 50*a* functions as an element that outputs the information on the temperature of the flavor source 33.

In step S3, the MCU 50 may acquire the temperature of the flavor source 33 acquired based on the output of the temperature detection element T1 as the capsule temperature parameter $T_{capsule}$, and set the acquired temperature of the flavor source 33 as the target temperature $T_{cap_target}$ of the flavor source 33. Accordingly, the capsule temperature parameter $T_{capsule}$ can be acquired more accurately.

After step S2 or step S3, the MCU 50 determines the aerosol weight $W_{aerosol}$ necessary for achieving the target amount of the flavor component $W_{flavor}$ by calculation of Equation (4), based on the set target temperature $T_{cap_target}$ and a current flavor component remaining amount $W_{capsule}$ ($n_{puff}$) of the flavor source 33 (step S4). Equation (4) is obtained by modifying Equation (2) in which $T_{capsule}$ is set as $T_{cap_target}$.

$$W_{aerosol}=W_{flavor}/[\beta\times\{W_{capsule}(n_{puff})\times T_{cap_target}\}\times\gamma] \quad (4)$$

Next, the MCU 50 determines the atomization power $P_{liquid}$ necessary for implementing the aerosol weight $W_{aerosol}$ determined in step S4 by calculation of Equation (1) in which $t_{sense}$ is set to the first default value $t_{upper}$ (step S5).

A table in which a combination of the target temperature $T_{cap_target}$ and the flavor component remaining amount $W_{capsule}$ ($n_{puff}$) is associated with the atomization power $P_{liquid}$ may be stored in the memory 50*a* of the MCU 50, and the MCU 50 may determine the atomization power $P_{liquid}$ by using the table. Accordingly, the atomization power $P_{liquid}$ can be determined at high speed and low power consumption.

Next, the MCU 50 determines whether the atomization power $P_{liquid}$ determined in step S5 is equal to or smaller than a second default value (step S6). The second default value is a maximum value of power that can be discharged from the power supply 12 to the first load 21 at that time, or a value obtained by subtracting a predetermined value from the maximum value.

When discharging from the power supply 12 to the first load 21, a current that flows through the first load 21 and a voltage of the power supply 12 are respectively referred to as I and $V_{LIB}$, an upper limit value of a boost rate of the DC/DC converter 51 is referred to as $\eta_{upper}$, an upper limit value of an output voltage of the DC/DC converter 51 is referred to as $P_{DC/DC_upper}$, the second default value is referred to as $P_{upper}$, and an electric resistance value of the first load 21 in a state where the temperature of the first load 21 reaches a boiling point temperature of the aerosol source 22 is referred to as $R_{HTR}$ ($T_{HTR}=T_{B.P}$). With this description, the second default value $P_{upper}$ can be expressed by the following Equation (5).

$$P_{upper} = I \cdot V_{LIB} = \mathrm{MIN}\left(\frac{(\eta_{upper} \cdot V_{LIB})^2}{R_{HTR}(T_{HTR} = T_{B.P.})} P_{DC/DC-upper}\right) - \Delta \quad (5)$$

In Equation (5), A=0 is an ideal value of the second default value $P_{upper}$. However, in an actual circuit, it may be desired to consider a resistance component of a lead wire connected to the first load 21, a resistance component other than a resistance component connected to the first load 21, and the like. Therefore, in order to provide a certain margin, the adjustment value A is introduced in Equation (5).

In the aerosol inhaler 1, the DC/DC converter 51 is not essential and may be omitted. When the DC/DC converter 51 is omitted, the second default value $P_{upper}$ can be expressed by the following Equation (6).

$$P_{upper} = I \cdot V_{LIB} = \frac{V_{LIB}^2}{R_{HTR}(T_{HTR} = T_{B.P.})} - \Delta \quad (6)$$

When the atomization power $P_{liquid}$ determined in step S5 exceeds the second default value $P_{upper}$ (step S6: NO), the MCU 50 increases the target temperature $T_{cap_target}$ by a predetermined amount, and returns the processing to step S4. As can be seen from Equation (4), by increasing the target temperature $T_{cap_target}$, the aerosol weight $W_{aerosol}$ necessary for achieving the target amount of the flavor component $W_{flavor}$ can be reduced. As a result, the atomization power $P_{liquid}$ determined in step S5 can be reduced. Since steps S4 to S7 are repeated, the MCU 50 can set the determination in step S6 in which NO is initially determined to YES, and shift the processing to step S8.

When the atomization power $P_{liquid}$ determined in step S5 is equal to or smaller than the second default value $P_{upper}$ (step S6: YES), the MCU 50 acquires a current temperature $T_{cap_sense}$ of the flavor source 33 based on the output of the temperature detection element T1 (step S8).

Then, the MCU 50 controls discharging to the second load 31 for heating the second load 31 based on the temperature $T_{cap_sense}$ and the target temperature $T_{cap_target}$ (step S9). Specifically, the MCU 50 supplies power to the second load 31 by proportional-integral-differential (PID) control or ON/OFF control such that the temperature $T_{cap_sense}$ converges to the target temperature $T_{cap_target}$.

In the PID control, a difference between the temperature $T_{cap_sense}$ and the target temperature $T_{cap_target}$ is fed back, and power control is performed based on a feedback result thereof such that the temperature $T_{cap_sense}$ converges to the target temperature $T_{cap_target}$. According to the PID control, the temperature $T_{cap_sense}$ can converge to the target temperature $T_{cap_target}$ with high accuracy. The MCU 50 may use proportional (P) control or proportional-integral (PI) control instead of the PID control.

The ON/OFF control is control in which power is supplied to the second load 31 in a state where the temperature $T_{cap_sense}$ is lower than the target temperature $T_{cap_target}$, and the power supply to the second load 31 is stopped until the temperature $T_{cap_sense}$ becomes lower than the target temperature $T_{cap_target}$ in a state where the temperature $T_{cap_sense}$ is equal to or higher than the target temperature $T_{cap_target}$. According to the ON/OFF control, the temperature of the flavor source 33 can be increased faster than the PID control. Therefore, it is possible to increase a possibility that the temperature $T_{cap_sense}$ reaches the target temperature $T_{cap_target}$ at a stage before an aerosol generation request described later is detected. The target temperature $T_{cap_target}$ may have hysteresis.

After step S9, the MCU 50 determines presence or absence of an aerosol generation request (step S10). When the aerosol generation request is not detected (step S10: NO), the MCU 50 determines a length of a time during which the aerosol generation request is not made (hereinafter, referred to as non-operation time) in step S11. Then, when the non-operation time reaches a predetermined time (step S11: YES), the MCU 50 ends the discharging to the second load 31 (step S12), and performs shifting to the sleep mode in which power consumption is reduced (step S13). When the non-operation time is less than the predetermined time (step S11: NO), the MCU 50 shifts the processing to step S8.

When the aerosol generation request is detected (step S10: YES), the MCU 50 ends the discharging to the second load 31, and acquires a temperature $T_{cap_sense}$ of the flavor source 33 at that time based on the output of the temperature detection element T1 (step S14). Then, the MCU 50 determines whether the temperature $T_{cap_sense}$ acquired in step S14 is equal to or higher than the target temperature $T_{cap_target}$ (step S15).

When the temperature $T_{cap_sense}$ is lower than the target temperature $T_{cap_target}$ (step S15: NO), the MCU 50 supplies the first load 21 with atomization power $P_{liquid}$ (second power) obtained by increasing the atomization power $P_{liquid}$ (first power) determined in step S5 by a predetermined amount, and starts heating the first load 21 (step S19). The increase in power here is determined within a range in which the atomization power $P_{liquid}$ does not exceed the ideal value of the second default value $P_{upper}$ described above.

For example, in steps S17 and S19, it is assumed that atomization power (power determined by the MCU 50) to be supplied to the first load 21 is a value at which power can be discharged from the power supply 12 to the first load 21 even when boost by the DC/DC converter 51 is not performed (in other words, even when the boost by the DC/DC converter 51 is stopped). In this case, the MCU 50 preferably controls a switching element of the DC/DC converter 51 such that the DC/DC converter 51 outputs an input voltage as it is, and supplies a voltage from the power supply 12 to the first load 21 without boosting the voltage. As an example, when the DC/DC converter 51 is a boost-type switching regulator, the DC/DC converter 51 can output the input voltage as it is by keeping the switching element off. Accordingly, it is possible to reduce power loss due to the boost by the DC/DC converter 51 and to suppress power consumption.

On the other hand, for example, in steps S17 and S19, it is assumed that the atomization power to be supplied to the first load 21 is a value at which power cannot be discharged from the power supply 12 to the first load 21 unless the boost by the DC/DC converter 51 is performed. In this case, the MCU 50 may control the switching element of the DC/DC converter 51 such that the DC/DC converter 51 boosts the input voltage and outputs the boosted input voltage to boost the voltage from the power supply 12 and supply the boosted voltage to the first load 21. Accordingly, it is possible to supply necessary power to the first load 21 while suppressing power consumption. As is clear from Equations (5) and (6), when the DC/DC converter 51 is provided, it is possible to increase power that can be discharged from the power supply 12 to the first load 21. Therefore, the unit flavor amount can be made more stable.

After the heating of the first load 21 is started in step S19, the MCU 50 continues the heating when the aerosol generation request is not ended (step S20: NO), and stops the power supply to the first load 21 when the aerosol generation request is ended (step S20: YES) (step S21).

In step S15, when the temperature $T_{cap_sense}$ is equal to or higher than the target temperature $T_{cap_target}$ (step S15: YES), the MCU 50 starts heating the first load 21 by supplying the atomization power $P_{liquid}$ (the first power) determined in step S5 to the first load 21, and generates an aerosol (step S17).

After the heating of the first load 21 is started in step S17, the MCU 50 continues the heating when the aerosol generation request is not ended (step S18: NO), and stops the power supply to the first load 21 when the aerosol generation request is ended (step S18: YES) (step S21).

The MCU 50 may control the heating of the first load 21 in steps S17 and S19 based on the output of the temperature detection element T2. For example, when the MCU 50 executes the PID control or the ON/OFF control using the boiling point of the aerosol source 22 as the target temperature based on the output of the temperature detection element T2, overheating of the first load 21 or the aerosol source 22 can be prevented, and an amount of the aerosol source 22 atomized by the first load 21 can be highly controlled.

Figure 11:
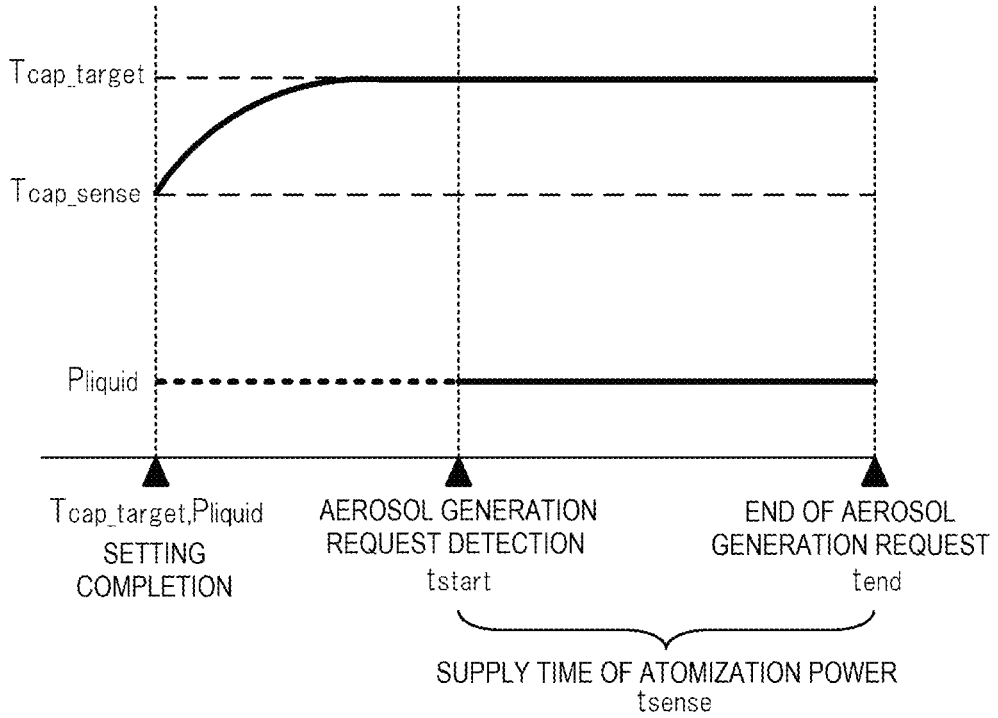
FIG. 11 is a schematic diagram showing atomization power supplied to a first load in step S17 of FIG. 10.
Figure 12:
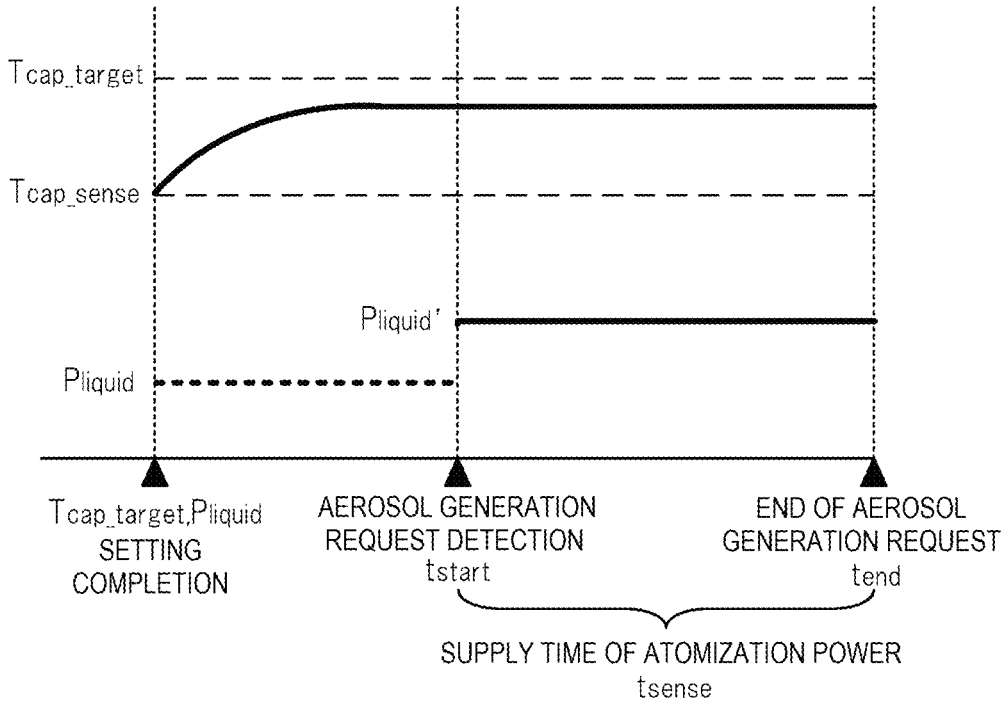
FIG. 12 is a schematic diagram showing atomization power supplied to the first load in step S19 of FIG. 10.

FIG. 11 is a schematic diagram showing the atomization power supplied to the first load 21 in step S17 of FIG. 10. FIG. 12 is a schematic diagram showing the atomization power supplied to the first load 21 in step S19 of FIG. 10. As shown in FIG. 12, when the temperature $T_{cap_sense}$ has not reached the target temperature $T_{cap_target}$ at a time point at which the aerosol generation request is detected, the atomization power $P_{liquid}$ is increased and then supplied to the first load 21.

Accordingly, even when the temperature of the flavor source 33 does not reach the target temperature at a time point at which the aerosol generation request is made, an amount of a generated aerosol can be increased by performing the processing of step S19. As a result, a decrease in an amount of a flavor component added to an aerosol due to the temperature of the flavor source 33 being lower than the target temperature can be compensated for by the increase in the amount of the aerosol. Therefore, the amount of the flavor component added to the aerosol can converge to the target amount.

On the other hand, when the temperature of the flavor source 33 has reached the target temperature at the time point at which the aerosol generation request is made, a desired amount of the aerosol necessary for achieving the target amount of the flavor component is generated by the atomization power determined in step S5. Therefore, the amount of the flavor component added to the aerosol can converge to the target amount.

Next, the MCU 50 acquires the supply time $t_{sense}$ to the first load 21 of the atomization power supplied to the first load 21 in step S17 or step S19 (step S22). It should be noted that when the MCU 50 detects the aerosol generation request exceeding the first default value $t_{upper}$, the supply time $t_{sense}$ is equal to the first default value $t_{upper}$. Further, the MCU 50 increments the puff number counter by "1" (step S23).

The MCU 50 updates the flavor component remaining amount $W_{capsule}$ ($n_{puff}$) of the flavor source 33 based on the supply time $t_{sense}$ acquired in step S22, the atomization power supplied to the first load 21 in response to the aerosol generation request, and the target temperature $T_{cap_target}$ at the time point at which the aerosol generation request is detected (step S24).

When the control shown in FIG. 11 is performed, the amount of the flavor component added to an aerosol generated from a start to an end of the aerosol generation request can be obtained by the following Equation (7). ($t_{end}$–$t_{start}$) in Equation (7) indicates the supply time $t_{sense}$.

$$W_{flavor}=\beta\times(W_{capsule}(n_{puff})\times T_{cap_target})\times\gamma\times\alpha\times P_{liquid}\times(t_{end}-t_{start}) \quad (7)$$

When the control shown in FIG. 12 is performed, the amount of the flavor component added to the aerosol generated from the start to the end of the aerosol generation request can be obtained by the following Equation (8). ($t_{end}$–$t_{start}$) in Equation (8) indicates the supply time $t_{sense}$.

$$W_{flavor}=\beta\times(W_{capsule}(n_{puff})\times T_{cap_target})\times\gamma\times\alpha\times P_{liquid}'\times(t_{end}-t_{start}) \quad (8)$$

$W_{flavor}$ for each aerosol generation request obtained in this way is accumulated in the memory 50*a*, and values of $W_{flavor}$ at the time of current aerosol generation and past $W_{flavor}$ including $W_{flavor}$ at the time of aerosol generation before a previous time are substituted into Equation (3), so that the flavor component remaining amount $W_{capsule}$ ($n_{puff}$) after the aerosol generation can be derived with high accuracy and updated.

After step S24, the MCU 50 determines whether the updated flavor component remaining amount $W_{capsule}$ ($n_{puff}$) is less than a remaining amount threshold (step S25). When the updated flavor component remaining amount $W_{capsule}$ ($n_{puff}$) is equal to or larger than the remaining amount threshold (step S25: NO), the MCU 50 shifts the processing to step S28. When the updated flavor component remaining amount $W_{capsule}$ ($n_{puff}$) is less than the remaining amount threshold (step S25: YES), the MCU 50 causes the notification unit 45 to perform a notification prompting replacement of the second cartridge 30 (step S26). Then, the MCU 50 resets the puff number counter to an initial value (=0), erases the value of the past $W_{flavor}$ described above, and initializes the target temperature $T_{cap_target}$ (step S27).

The initialization of the target temperature $T_{cap_target}$ means that the target temperature $T_{cap_target}$ stored in the memory 50*a* at that time point is excluded from a set value. Therefore, even when the target temperature $T_{cap_target}$ is initialized, the target temperature $T_{cap_target}$ set immediately before remains stored in the memory 50*a*. The stored target temperature $T_{cap_target}$ is used as the capsule temperature parameter $T_{capsule}$ acquired when the MCU 50 executes step S2 next.

As another example, when step S1 and step S2 are omitted and step S3 is always executed, the initialization of the target temperature $T_{cap_target}$ means that the target temperature $T_{cap_target}$ at that time point stored in the memory 50*a* is set to a normal temperature or a room temperature.

After step S27, when the power supply is not turned off (step S28: NO), the MCU 50 returns the processing to step S1, and when the power supply is turned off (step S28: YES), the MCU 50 ends the processing.

Here, details of the remaining amount threshold used in the determination in step S25 will be described.

The flavor component remaining amount $W_{capsule}$ ($n_{puff}$) can be expressed by the following Equation (9) based on Equations (1) and (2).

$$W_{capsule}(n_{puff})=\frac{W_{flavor}}{\beta\cdot T_{capsule}\cdot\gamma\cdot W_{aerosol}}=\frac{W_{flavor}}{\beta\cdot T_{capsule}\cdot\gamma\cdot\alpha\cdot P_{liquid}\cdot t_{sense}} \quad (9)$$

In order to implement the target amount of the flavor component $W_{flavor}$, it may be desired to satisfy a relationship of Equation (9) under a most strictest condition (a state where the discharging to the first load 21 is continued to a maximum extent, the temperature of the flavor source 33 reaches an upper limit, and the voltage of the power supply 12 is at a minimum dischargeable value (an end-of-discharging voltage $V_{EOD}$)). In other words, under the strictest condition, if a left side of Equation (9) is less than a right side, the target amount of the flavor component $W_{flavor}$ cannot be implemented.

In Equation (9), the amount of the flavor component $W_{flavor}$ is intended to converge to a target amount, and thus can be treated as a known value. In Equation (9), α, β, and γ are constants. Further, in Equation (9), since the first default value $t_{upper}$ exists as the upper limit value of $t_{sense}$, the upper limit value can be substituted as a value of the strictest condition. Further, in Equation (9), the $T_{capsule}$ can substitute an upper limit temperature $T_{max}$ of the flavor source 33 that can be heated by the second load 31 as a value of the strictest condition. The upper limit temperature $T_{max}$ is determined by a heat-resistant temperature of a material of a container that houses the flavor source 33 or the like. As a specific example, the upper limit temperature $T_{max}$ may be 80° C. Further, in Equation (9), the $P_{liquid}$ can substitute the second default value $P_{upper}$ obtained by substituting the end-of-discharging voltage $V_{EOD}$ into the voltage $V_{LIB}$ in Equation (5) as a value of the strictest condition. When these values are substituted into Equation (9), Equation (10) is obtained.

$$W_{capsule}(n_{puff}) = \frac{W_{flavor}}{\alpha \times \beta \times \gamma \times \left\{ \mathrm{MIN}\left( \frac{(\eta_{upper} \cdot V_{EOD})^2}{R_{HTR}(T_{HTR} = T_{B.P.})} P_{DC/DC_upper} \right) - \Delta \right\} \times t_{uppper} \times T_{max}} \quad (10)$$

Therefore, by setting the remaining amount threshold to a value on a right side of Equation (10), it is possible to prompt the user to replace the second cartridge 30 at an appropriate timing. A state where the flavor component remaining amount $W_{capsule}$ ($n_{puff}$) is less than the right side of Equation (10) constitutes any one of a state where the amount of the flavor component is smaller than the target amount when the first load 21 is discharged in response to the aerosol generation request, a state where the amount of the flavor component is smaller than the target amount when the first load 21 is discharged for a maximum time (the first default time $t_{upper}$) in response to the aerosol generation request, and a state where the amount of the flavor component is smaller than the target amount when maximum dischargeable power ($P_{upper}$) is supplied from the power supply 12 to the first load 21 in response to the aerosol generation request. The maximum power is power that can be supplied from the power supply 12 to the first load 21 or power that can be discharged from the power supply 12 in an end-of-discharging state to the first load 21 when the voltage of the power supply 12 is boosted to a maximum voltage that can be boosted by the DC/DC converter 51.

Since the remaining amount threshold is set in this way, it is possible to prompt the user to replace the second cartridge 30 in a state before the amount of the flavor component is smaller than the target amount. Therefore, it is possible to prevent the user from inhaling an aerosol to which a small amount of the flavor component that does not reach the target is added, and it is possible to further increase a commercial value of the aerosol inhaler 1.

Based on the output of the liquid sensor 16, the MCU 50 detects the adhesion of the liquid formed by the aggregation of the aerosol to the second load 31 or the entry of the liquid into the conductive portion 71. In the aerosol inhaler 1, as described above, air that flows in from the intake port (not shown) provided in the power supply unit case 11 passes from the air supply unit 42 to a vicinity of the first load 21 of the first cartridge 20. The first load 21 atomizes the aerosol source 22 drawn from the reservoir 23 by the wick 24. An aerosol generated by atomization flows through the aerosol flow path 25 together with the air that flows in from the intake port, and is supplied to the second cartridge 30 via the communication path 26*b*. The aerosol supplied to the second cartridge 30 passes through the flavor source 33 to add a flavor component, and is supplied to the inhale port 32.

Here, if the aerosol remaining in the aerosol flow path 25 is cooled and aggregated, the remaining aerosol becomes a liquid, and the liquid may adhere to the second load 31 or enter the conductive portion 71.

Figure 13:
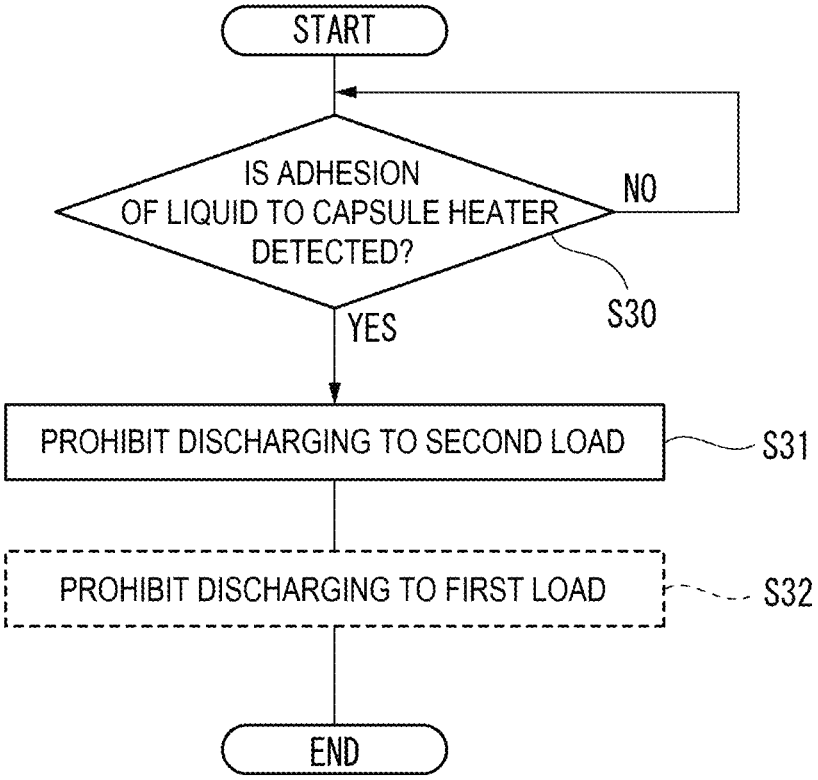
FIG. 13 is a flowchart for illustrating a liquid detection processing.
Figure 14:
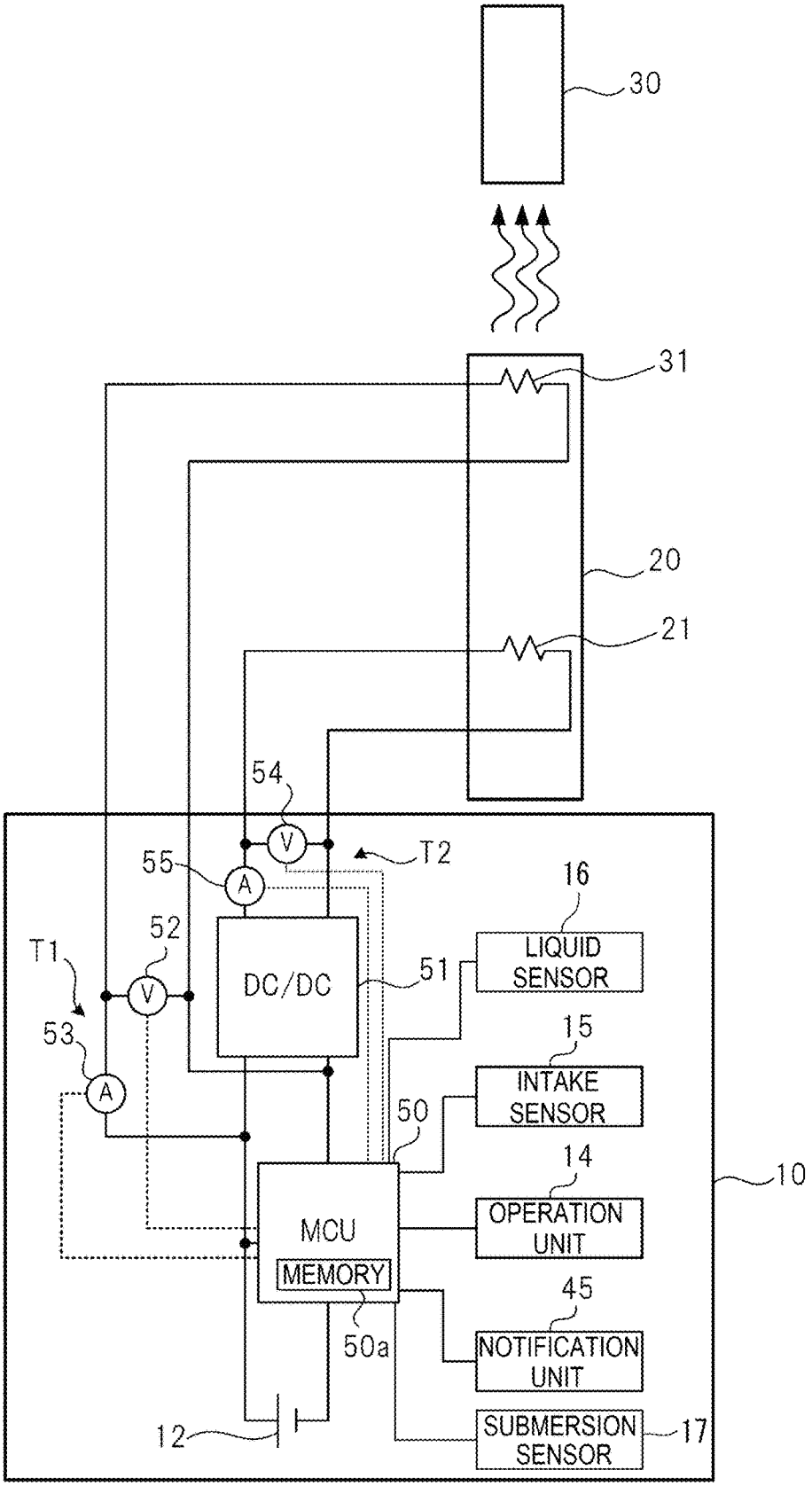
FIG. 14 is a schematic diagram showing a hardware configuration of a modification of the aerosol inhaler.

The MCU 50 performs a liquid detection processing at the end of discharging from the power supply 12 to the first load 21, or the like. FIG. 13 is a flowchart for illustrating the liquid detection processing.

Based on the output of the liquid sensor 16, the MCU 50 determines whether the liquid formed by the aggregation of the aerosol has adhered to the second load 31 (step S30). As a result, when there is no adhesion of the liquid to the second load 31 (step S30: NO), the determination is repeated until there is the adhesion of the liquid to the second load 31. When the liquid adheres to the second load 31 (step S30: YES), the MCU 50 prohibits the discharging to the second load 31 as the first fail-safe action (step S31). Instead of the first fail-safe action, a notification action for causing the notification unit 45 to execute a notification of occurrence of an abnormality may be performed, or the notification action may be performed together with the first fail-safe action.

As the first fail-safe action, the discharging to the second load 31 may be prohibited, and the discharging to the first load 21 may also be prohibited (step S32). That is, when the liquid adheres to the second load 31, the MCU 50 may prohibit the discharging to the second load 31 and the discharging to the first load 21.

Accordingly, when the liquid adheres to the second load 31, safety of the aerosol inhaler 1 is improved by executing at least one of the first fail-safe action and the notification action. In the description of FIG. 13, a case where the liquid sensor 16 detects the adhesion of the liquid to the second load 31 is illustrated, but the liquid sensor 16 may be configured to detect the liquid that has entered the conductive portion 71, or may be configured to detect both the adhesion of the liquid and the entry of the liquid. When both the adhesion of the liquid and the entry of the liquid can be detected, the MCU 50 may execute at least one of the first fail-safe action and the notification action at a time point at which any one of them is detected.

The adhesion and the entry of the liquid are likely to occur when an energization time of the first load 21 is approximately the same as the inhale time of the user. That is, in such a case, a part of the aerosol weight $W_{aerosol}$, which should have originally passed through the flavor source 33, remains in the aerosol flow path 25 and aggregates to become a liquid. As described above, the aerosol weight $W_{aerosol}$ is proportional to the atomization power $P_{liquid}$ and the supply time $t_{sense}$ of the atomization power $P_{liquid}$ to the first load 21. Therefore, the MCU 50 may vary the first default value $t_{upper}$ (for example, 2.4 seconds), which is the upper limit value of the supply time $t_{sense}$, in accordance with the atomization power $P_{liquid}$. That is, the larger the atomization power $P_{liquid}$, the smaller the first default value $t_{upper}$ may be. Further, when the atomization power $P_{liquid}$ is larger than a predetermined value, the first default value $t_{upper}$ may be reduced. Accordingly, it is possible to make it difficult to generate the liquid that induces the adhesion or the entry of the liquid.

The MCU 50 may include a submersion detection unit in addition to the liquid detection unit. In this case, a capacitor or a pseudo capacitor similar to that described above is also disposed in an opening that connects an inside and an outside of the power supply unit 10 provided in the power supply unit case 11, and a submersion sensor 17 that outputs an electrostatic capacitance of the capacitor or the pseudo capacitor is connected to the MCU 50.

The submersion sensor 17 is a sensor for detecting the entry of water into the power supply unit 10, and is an electrostatic capacitance sensor that outputs an electrostatic capacitance in the vicinity of the opening. The submersion sensor 17 may be configured with an electrostatic capacitance digital converter (CDC) similarly to the liquid sensor 16. The MCU 50 detects the entry of the water into the power supply unit 10 based on the output of the submersion sensor 17. More specifically, when an output value of the submersion sensor 17 or a change in the output value exceeds a threshold, the MCU 50 determines that the water has entered the inside of the power supply unit 10, that is, submersion has occurred.

As shown in FIG. 3, examples of the opening include a first opening K1 where the charging terminal 43 is provided, a second opening K2 that is the air supply unit 42, and a third opening K3 where the operation unit 14 is provided, and capacitors or pseudo capacitors are provided in these openings. Further, the present invention is not limited thereto. The capacitor or the pseudo capacitor may be provided in an intake port (not shown) provided in the power supply unit case 11, or may be provided in a connection portion between the power supply unit case 11 and the first cartridge 20 without being limited to the opening. However, it is preferable that the capacitor 77 or the pseudo capacitor connected to the liquid sensor 16 is provided in the vicinity of the second load 31, and the capacitor or the pseudo capacitor connected to the submersion sensor 17 is not provided in the vicinity of the second load 31. Accordingly, it is possible to prevent erroneous recognition between an event detected by the liquid sensor 16 and an event detected by the submersion sensor 17.

Figure 15:
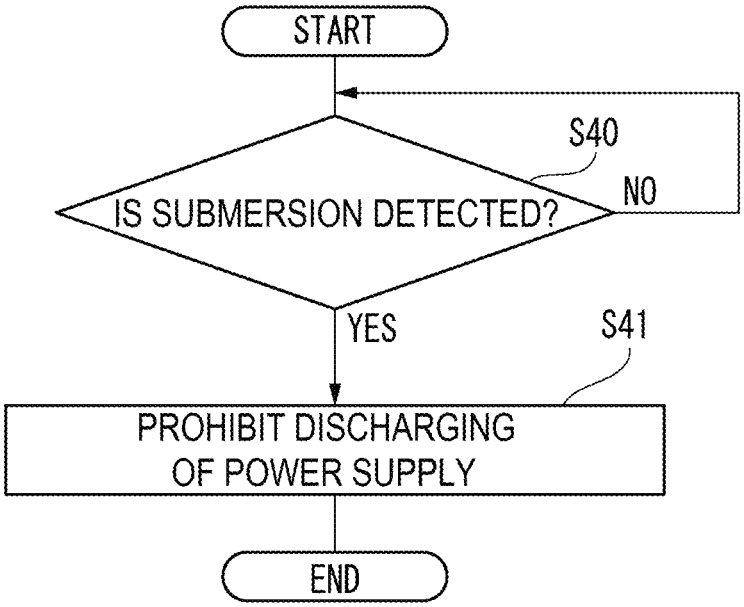
FIG. 15 is a flowchart for illustrating a submersion detection processing.

FIG. 15 is a flowchart for illustrating a submersion detection processing. Based on the output of the submersion sensor 17, the MCU 50 determines whether the water has entered the opening, that is, whether the aerosol inhaler 1 has been submerged (step S40). As a result, when there is no submersion (step S40: NO), the determination is repeated until there is submersion. When there is submersion (step S40: YES), discharging of the power supply 12 is prohibited as a second fail-safe action (step S41). Accordingly, by executing a fail-safe action different from the adhesion of the liquid to the second load 31 and the entry of the liquid into the conductive portion 71 during submersion, it is possible to execute an appropriate fail-safe action for each generated abnormality. The safety of the aerosol inhaler can be further improved by prohibiting discharging from the power supply 12 during submersion. At this time, the notification action for causing the notification unit 45 to execute the notification of occurrence of an abnormality may be performed. It is preferable that the notification of the notification unit 45 differs between when the liquid adheres to the second load 31 or when the liquid enters the conductive portion 71 and when the submersion occurs.

Figure 8:
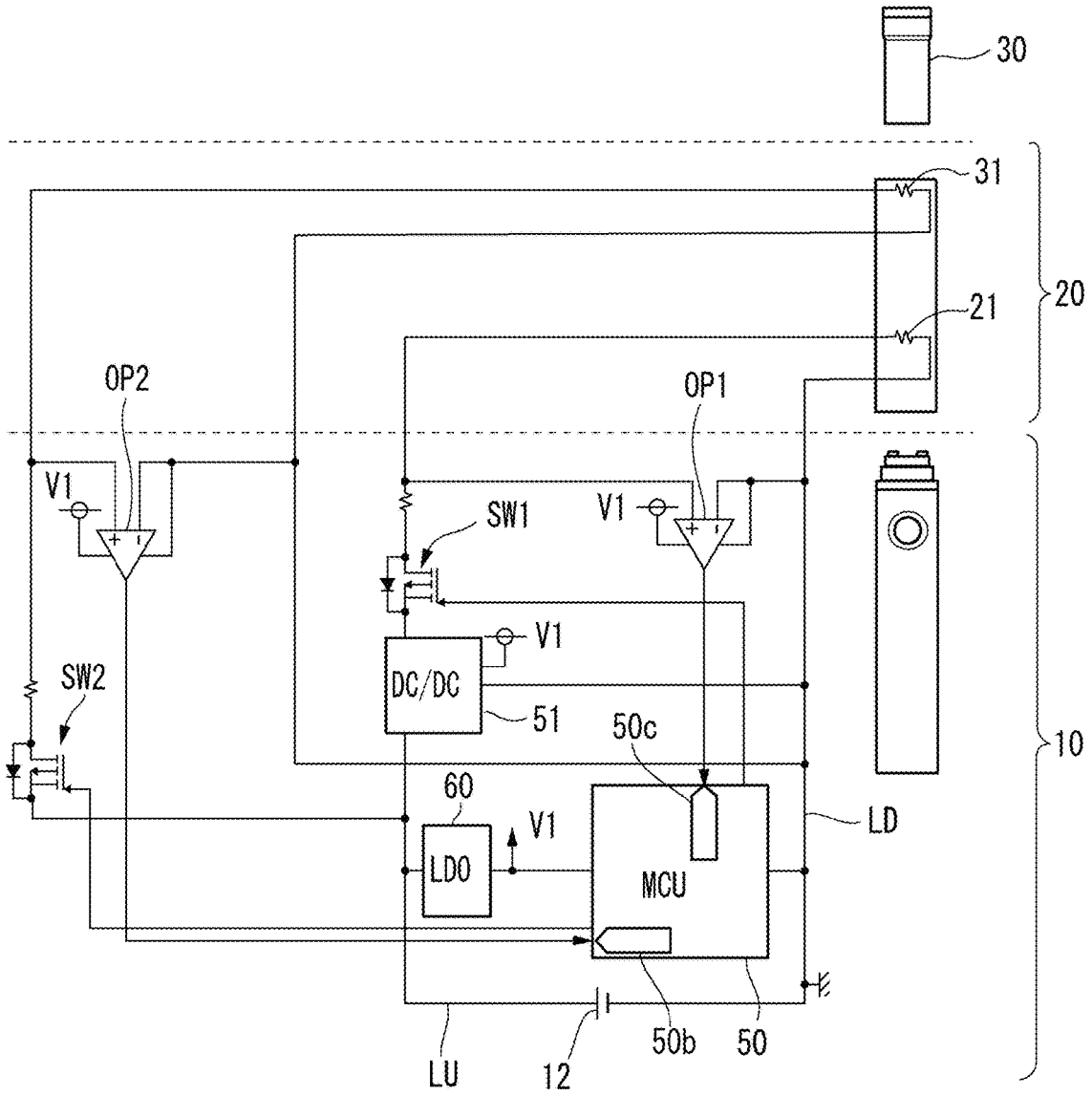
FIG. 8 is a diagram showing a modification of the power supply unit shown in FIG. 6.

A case where the liquid sensor 16 is an electrostatic capacitance sensor has been described so far, but as described above, the liquid sensor 16 may be a sensor that outputs a value related to an electric resistance value of the second load 31. If the second load 31 to which the liquid adheres is energized, the liquid causes a chemical change to change the electric resistance value of the second load 31. The MCU 50 only needs to be able to detect the change via the value related to the electric resistance value of the second load 31. For example, as shown in FIG. 8, the operational amplifier OP2 and the analog-to-digital converter (ADC) 50*b* that constitute the voltage sensor 52 in the circuit example shown in FIG. 7 can also serve as the liquid sensor 16. In this case, the CDC 56, and the capacitor 77 or the pseudo capacitor in the circuit example shown in FIG. 7 are unnecessary.

In the circuit diagram shown in FIG. 8, the operational amplifier OP2 and the ADC 50*b* output a voltage value of the second load 31, and the MCU 50 acquires the resistance value of the second load 31 based on the voltage value. The MCU 50 acquires the temperature of the second load 31 as the temperature of the flavor source 33 based on the resistance value of the second load 31, and detects adhesion of the liquid to the second load 31. For example, it is possible to detect the adhesion of the liquid to the second load 31 when the resistance value of the second load 31 suddenly changes, or in a case where the resistance value of the second load 31 fluctuates by a predetermined value or more when power is not supplied to the second load 31.

Second Embodiment

Next, the aerosol inhaler 1 of a second embodiment will be described.

In the aerosol inhaler 1 of the first embodiment, the power supply unit 10, the first cartridge 20, and the second cartridge 30 are arranged in a line, and the second cartridge 30 is replaceable with respect to the first cartridge 20, but the aerosol inhaler 1 of the second embodiment is different in that the first cartridge 20 and the second cartridge 30 are replaceable with respect to the power supply unit 10. Hereinafter, only differences will be described in detail, the same or equivalent configurations will be denoted by the same reference numerals in FIGS. 16 to 19, and description thereof will be omitted.

(Aerosol Inhaler)

The aerosol inhaler 1 preferably has a size that fits in a hand, and has a substantially rectangular parallelepiped shape. The aerosol inhaler 1 may have an ovoid shape, an elliptical shape, or the like. In the following description, in the substantially rectangular parallelepiped shaped aerosol inhaler, three orthogonal directions are referred to as an upper-lower direction, a front-rear direction, and a left-right direction in descending order of lengths. Further, in the following description, for the sake of convenience, a front side, a rear side, a left side, a right side, an upper side, and a lower side are defined, and the front side is represented by Fr, the rear side is represented by Rr, the left side is represented by L, the right side is represented by R, the upper side is represented by U, and the lower side is represented by D.

(Power Supply Unit)

Figure 16:
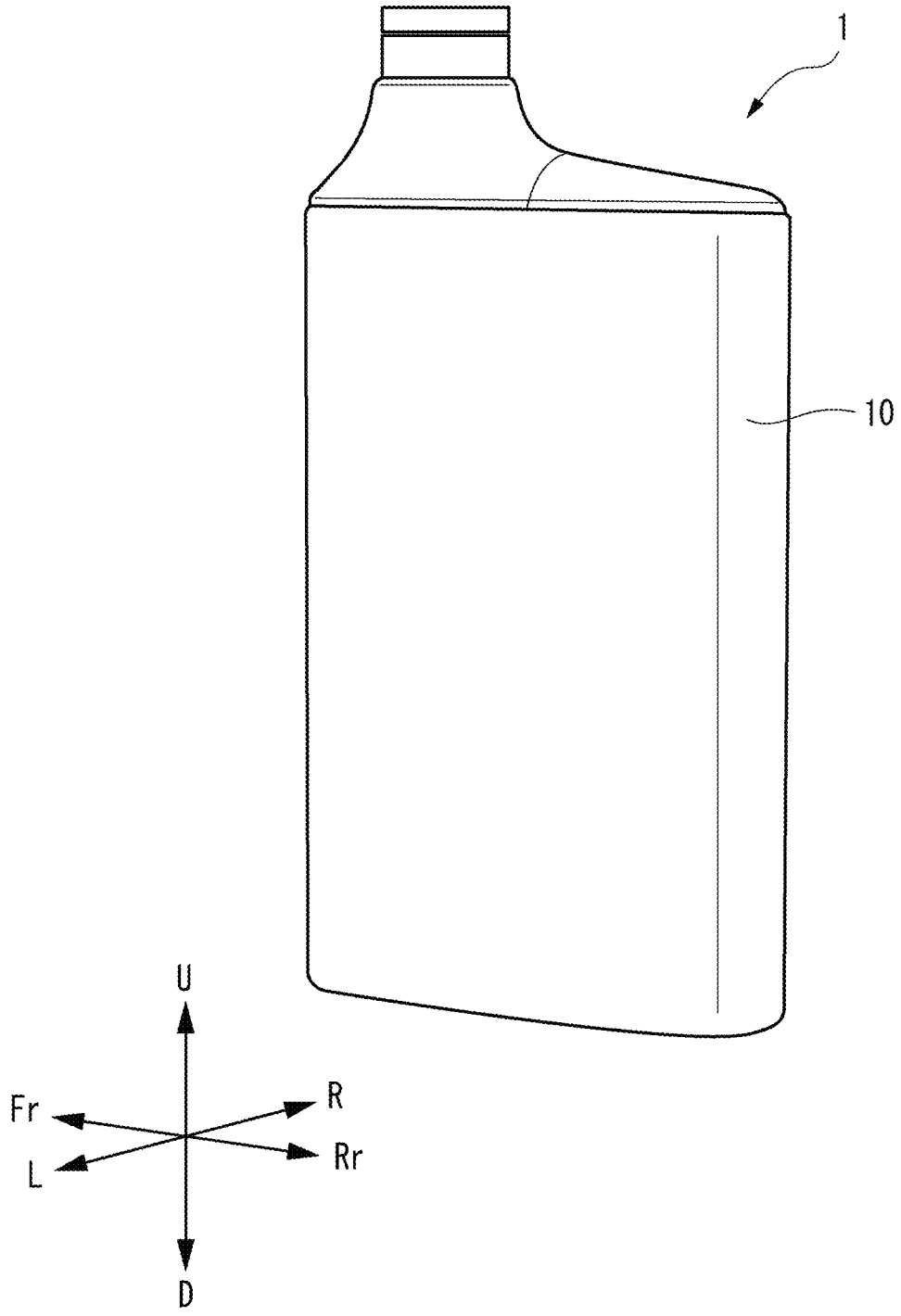
FIG. 16 is a perspective view schematically showing a schematic configuration of an aerosol inhaler of a second embodiment.
Figure 17:
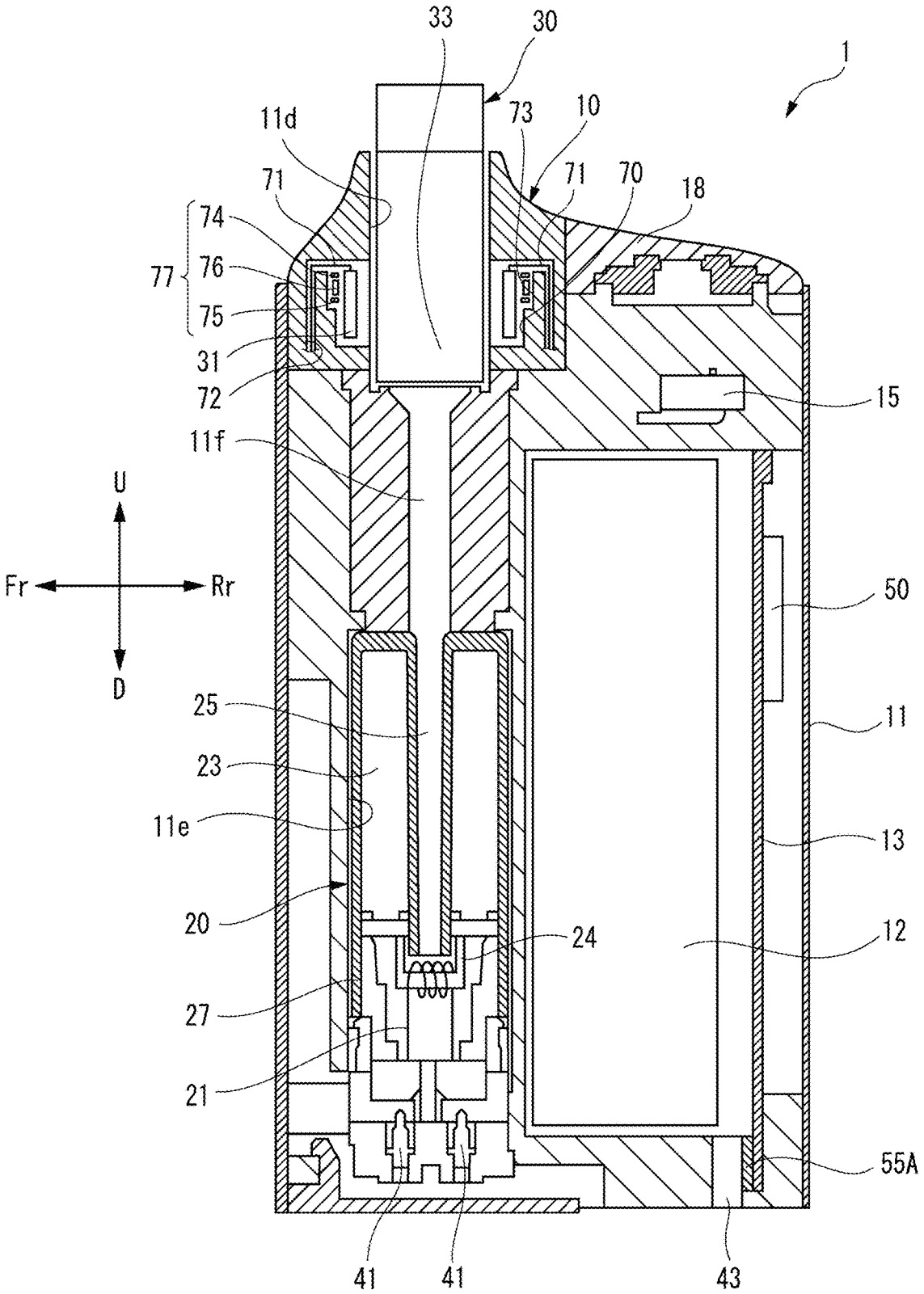
FIG. 17 is a cross-sectional view of the aerosol inhaler of FIG. 16.
Figure 18:
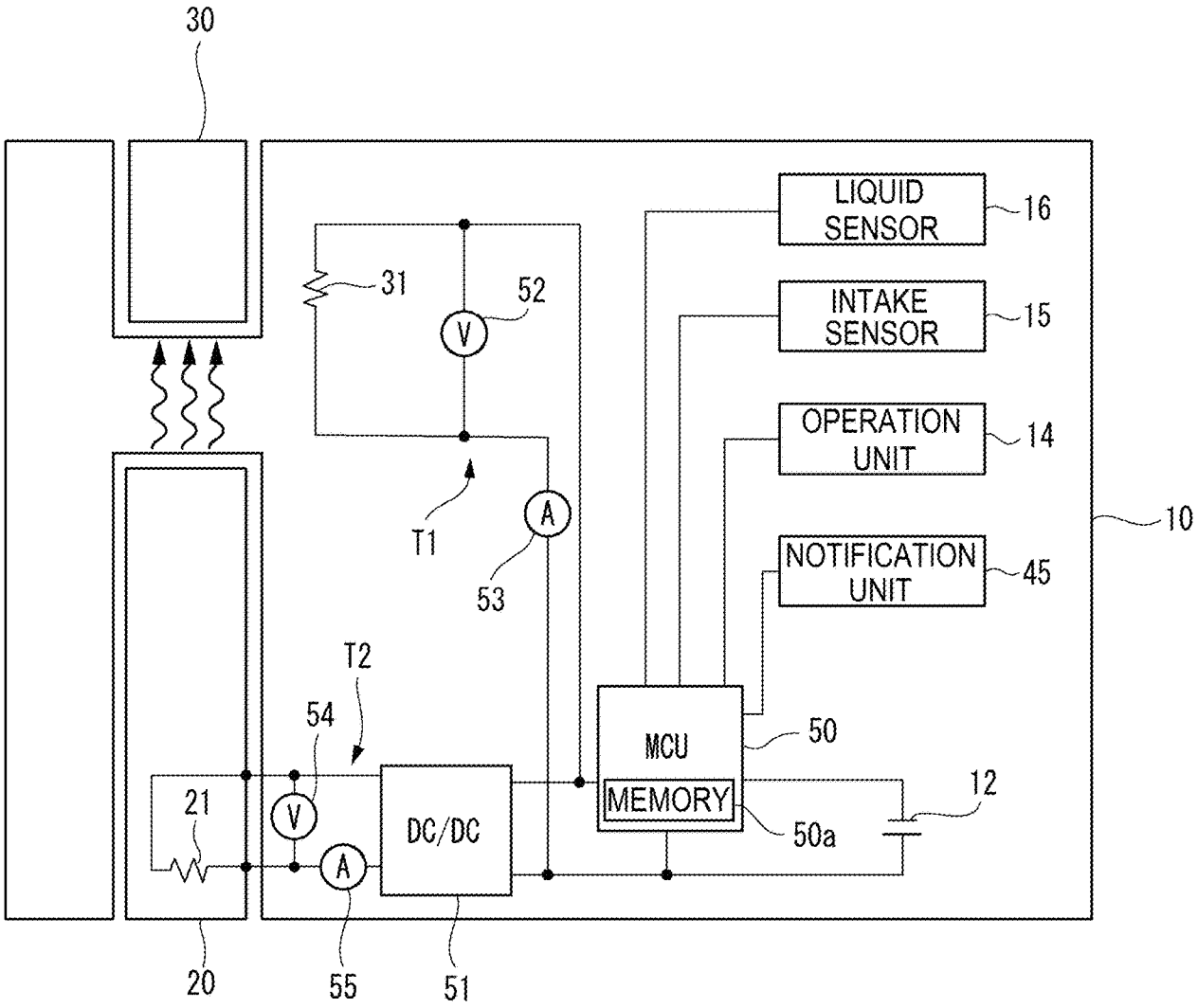
FIG. 18 is a schematic diagram showing a hardware configuration of the aerosol inhaler of FIG. 16.

As shown in FIGS. 16 to 18, the power supply unit 10 houses the power supply 12, the charging IC 55A, the MCU 50, the DC/DC converter 51, the intake sensor 15, the liquid sensor 16, the temperature detection element T1 including the voltage sensor 52 and the current sensor 53, the temperature detection element T2 including the voltage sensor 54 and the current sensor 55, the second load 31 for heating the second cartridge 30, and the circuit board 13 on which the DC/DC converter 51, the liquid sensor 16, the temperature detection element T1, and the temperature detection element T2 are mounted, inside the power supply unit case 11 having a substantially rectangular parallelepiped shape.

On a front side of the power supply unit case 11, a second cartridge housing portion 11*d* that removably houses the second cartridge 30 is provided on an upper side, a first cartridge housing portion 11*e* that removably houses the first cartridge 20 is provided on a lower side, and a communication path 11*f* that communicates the aerosol flow path 25 of the first cartridge 20 with the second cartridge housing portion 11*d* is provided between the second cartridge housing portion 11*d* and the first cartridge housing portion 11*e* in the upper-lower direction.

On a rear side of the power supply unit case 11, an operation unit 18 operable by a user is disposed on an upper surface, the charging terminal 43 is disposed on a lower surface, and the intake sensor 15, the power supply 12, and the circuit board 13 are arranged between the operation unit 18 and the charging terminal 43 in the upper-lower direction.

The second load 31 is embedded in the second load housing portion 70 disposed around the second cartridge housing portion 11*d*. The second load 31 heats the second cartridge 30 (more specifically, the flavor source 33 included therein) housed in the second cartridge housing portion 11*d* by power supplied from the power supply 12 via the conductive portion 71 that extends to the second load 31 inside the power supply unit 10.

In the vicinity of the second load 31, that is, in the second load housing portion 70, the auxiliary storage portion 73 that stores a liquid formed by aggregation of an aerosol is provided between the second load 31 and the conductive portion passage 72 through which the conductive portion 71 passes. The auxiliary storage portion 73 is provided with the pair of metal plates 74 and 75 and the porous body 76 disposed between the pair of metal plates 74 and 75, and the pair of metal plates 74 and 75 and the porous body 76 constitute the capacitor 77. Instead of the metal plate 75, a pseudo capacitor may be configured with a ground surface (for example, the power supply unit case 11) having a GND potential, which is similar to that in the first embodiment.

Instead of the auxiliary storage portion 73, the capacitor 77 or the pseudo capacitor may be provided in the conductive portion passage 72, which is a space through which the conductive portion 71 passes, or may be provided so as to sandwich the conductive portion passage 72, in order to detect a liquid that has entered the conductive portion 71. Alternatively, in addition to the auxiliary storage portion 73, the capacitor 77 or the pseudo capacitor may be provided in the conductive portion passage 72, or may be provided so as to sandwich the conductive portion passage 72.

(First Cartridge)

The first cartridge 20 includes the reservoir 23, the first load 21, the wick 24, and the aerosol flow path 25 inside the cylindrical cartridge case 27. Unlike the first embodiment, the end cap 26 that houses a part of the second cartridge 30 and the second load 31 are not provided.

(Second Cartridge)

The second cartridge 30 includes the flavor source 33 and the inhale port 32 as in the first embodiment.

Figure 19:
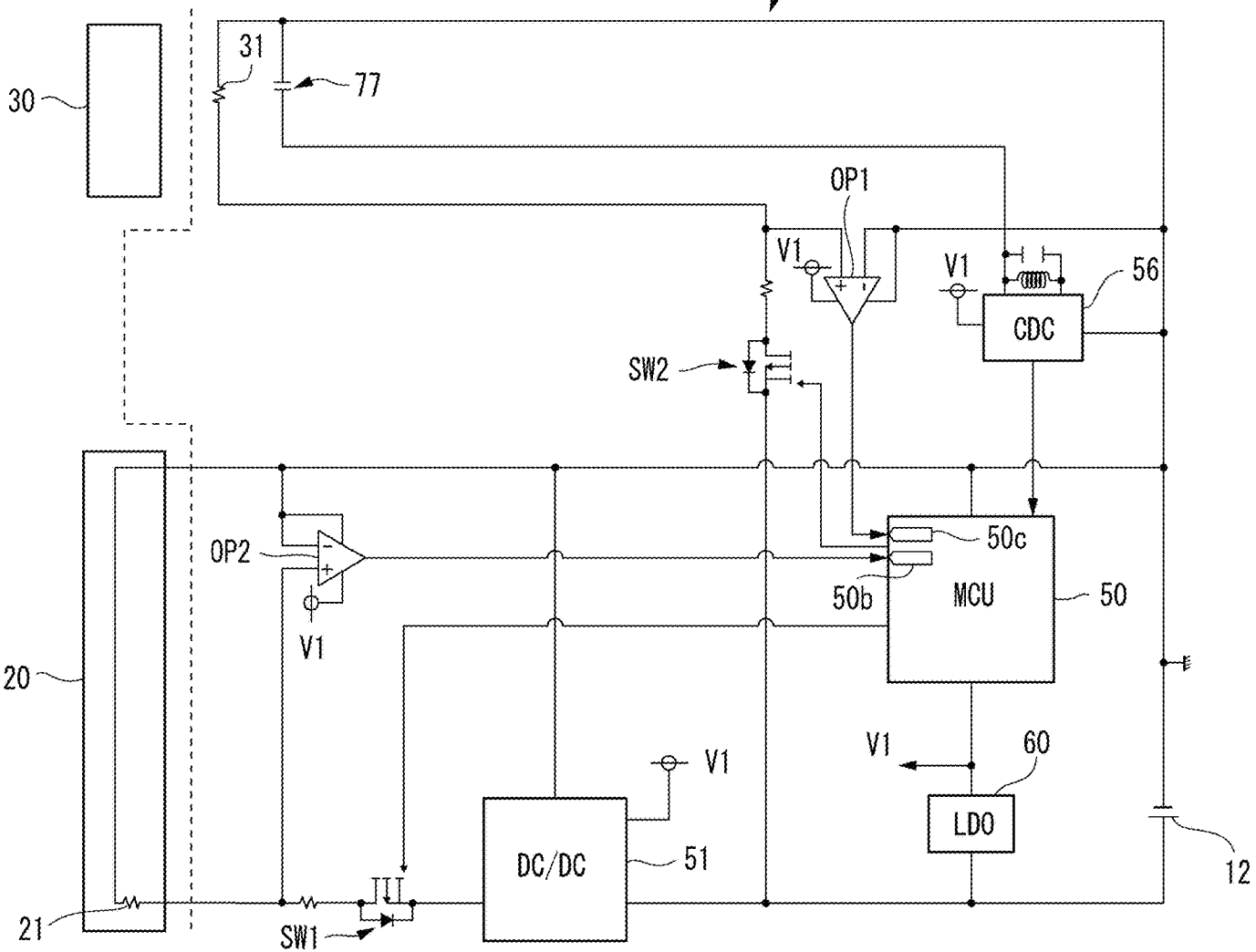
FIG. 19 is a diagram showing a specific example of a power supply unit shown in FIG. 18.

FIG. 18 is a schematic diagram showing a hardware configuration of the aerosol inhaler of the second embodiment. FIG. 19 is a diagram showing a specific example of the power supply unit 10 shown in FIG. 18. The configuration is the same as that of FIG. 6 except that the second load 31 is provided in the power supply unit 1. In the circuit example shown in FIG. 19, the liquid sensor 16 may be an electrostatic capacitance sensor (the CDC 56) or a sensor (the operational amplifier OP2 and the ADC 50*b*) that outputs a value related to an electric resistance value of the second load 31.

Also in the aerosol inhaler 1 of the present embodiment, the MCU 50 determines, based on an output of the liquid sensor 16, whether a liquid formed by aggregation of an aerosol has adhered to the second load 31 or the liquid has entered the conductive portion 71. When the liquid has adhered to the second load 31 or the liquid has entered the conductive portion 71, the MCU 50 performs the first fail-safe action and/or the notification action. Accordingly, safety of the aerosol inhaler 1 is improved.

According to the present embodiment, when the liquid sensor 16 is configured with the CDC 56, the capacitor 77 or the pseudo capacitor is provided in the power supply unit 10, so that a cost of the first cartridge 20 that is frequently replaced with a new product can be reduced. Further, also in the present embodiment, a temperature sensor for detecting the temperature of the second cartridge 30 may be provided instead of the temperature detection element T1, but in this case as well, the cost of the first cartridge 20 can be reduced by providing the temperature sensor in the power supply unit 10.

Although the embodiments are described above with reference to the drawings, it is needless to say that the present invention is not limited to such examples. It will be apparent to those skilled in the art that various changes and modifications may be conceived within the scope of the claims. It is also understood that the various changes and modifications belong to the technical scope of the present invention. Further, constituent elements in the embodiments described above may be combined freely within a range not departing from the spirit of the present invention.

At least the following matters are described in the present description. Corresponding constituent elements or the like in the above-described embodiments are shown in parentheses. However, the present invention is not limited thereto.

(1) A power supply unit (the power supply unit 10) for an aerosol inhaler (the aerosol inhaler 1) that causes an aerosol generated from an aerosol source (the aerosol source 22) to pass through a flavor source (the flavor source 33) to add a flavor component of the flavor source to the aerosol, the power supply unit including:

a power supply (the power supply 12) dischargeable to a first load (the first load 21) configured to heat the aerosol source and dischargeable to a second load (the second load 31) configured to heat the flavor source;

a notification unit (the notification unit 45);

a processing device (the MCU 50);

a circuit board (the circuit board 13) on which the processing device is mounted; and a conductive portion (the conductive portion 71) configured to electrically connect the second load and the circuit board, in which the processing device is configured to detect adhesion of a liquid to the second load or entry of the liquid into the conductive portion, and in which when the adhesion or the entry is detected, the processing device executes at least one of a notification action that causes the notification unit to execute a notification and a first fail-safe action including prevention of discharging from the power supply to the second load.

According to (1), it is possible to detect the adhesion of the liquid formed by aggregation of the aerosol to the second load, or the entry of the liquid into the conductive portion. Further, when the adhesion or the entry of the liquid is detected, the notification action and/or the first fail-safe action are/is executed, so that safety of an aerosol inhaler is improved.

(2) The power supply unit according to (1), in which the first fail-safe action further includes prevention of discharging from the power supply to the first load.

According to (2), when the above-described adhesion or entry is detected, the discharging from the power supply to the first load is also prevented in addition to preventing the discharging from the power supply to the second load, so that the safety of the aerosol inhaler is further improved.

(3) The power supply unit according to (1) or (2), in which an auxiliary storage portion (the auxiliary storage portion 73) configured to store the liquid is provided in a vicinity of the second load.

According to (3), the auxiliary storage portion prevents the entry of the liquid into the conductive portion, so that in addition to improving the safety of the aerosol inhaler, generation of the aerosol to which flavor is added can be continued while preventing the adhesion and the entry described above.

(4) The power supply unit according to any one of (1) to (3), further including:

an inhale sensor (the intake sensor 15) configured to output a value related to inhale of a user, in which the processing device detects a start of the inhale and an end of the inhale based on an output of the inhale sensor, in which the processing device starts discharging to the first load in response to a start of the inhale, in which when any one of an elapse of a predetermined time (the first default value $t_{upper}$) since a start of the inhale or a start of discharging to the first load and an end of the inhale is detected, the processing device stops discharging to the first load, in which the processing device is configured to control power discharged to the first load, and in which the processing device shortens the predetermined time as power discharged to the first load increases.

According to (4), by shortening an aerosol generation time as the power supplied to the first load increases, generation of the aerosol to which flavor is added can be continued while preventing the aggregation of the aerosol.

(5) The power supply unit according to any one of (1) to (4), further including:

a first sensor (the liquid sensor 16, the voltage sensor 52) configured to output a value related to an electric resistance value of the second load, in which the processing device detects the adhesion of the liquid based on an output of the first sensor.

According to (5), it is possible to detect the adhesion of the liquid in which the aerosol is aggregated, based on a resistance value of the second load that can be detected with a relatively inexpensive configuration.

(6) The power supply unit inhaler according to (5), in which an electric resistance value of the second load has a correlation with a temperature of the second load, and in which the processing device controls discharging from the power supply to the second load based on an output of the first sensor such that a temperature of the second load converges to a target temperature.

According to (6), since both the temperature of the second load and the adhesion of the liquid in which the aerosol is aggregated can be detected based on the electric resistance value of the second load output by the first sensor, a manufacturing cost of the power supply unit can be prevented.

(7) The power supply unit according to any one of (1) to (4), further including:

a second sensor (the liquid sensor 16, the CDC 56) configured to output an electrostatic capacitance between a first metal plate (the metal plate 74) disposed in a vicinity of the second load and a second metal plate (the metal plate 75) facing the first metal plate or between the first metal plate and a first ground surface, in which the processing device detects the adhesion of the liquid or the entry of the liquid based on an output of the second sensor.

According to (7), it is possible to detect the adhesion or the entry of the liquid based on a difference between an electrostatic capacitance when there is no adhesion or entry of the liquid and an electrostatic capacitance when there is the adhesion or the entry of the liquid. Accordingly, it is possible to detect with high accuracy whether there is the adhesion or the entry of the liquid.

(8) The power supply unit according to (7), in which an auxiliary storage portion (the auxiliary storage portion 73) configured to store the liquid is provided in a vicinity of the second load, in which the first metal plate and the second metal plate or the first metal plate and the first ground surface are arranged inside, at an end portion, or in a vicinity of the auxiliary storage portion, and in which the processing device detects the adhesion of the liquid based on an output of the second sensor.

According to (8), the processing device detects that the liquid formed by the aggregation of the aerosol has been collected by the auxiliary storage portion for collecting the liquid, so that the entry of the liquid into the conductive portion can be avoided.

(9) The power supply unit according to (8), in which a porous body (the porous body 76) is provided between the first metal plate and the second metal plate or between the first metal plate and the first ground surface.

According to (9), the liquid can be easily collected by the porous body, and the collected liquid can be detected by the processing device. Therefore, when the above-described adhesion occurs, the adhesion can be quickly detected while preventing the entry of the liquid into the circuit board.

(10) The power supply unit according to (7), in which the first metal plate and the second metal plate or the first metal plate and the first ground surface are provided in a space (the conductive portion passage 72) through which the conductive portion passes or are provided so as to sandwich the space through which the conductive portion passes, and in which the processing device detects the entry of the liquid based on an output of the second sensor.

According to (10), it is easy to detect the liquid that has entered the conductive portion, and it is possible to further improve the safety of the aerosol inhaler.

(11) The power supply unit according to any one of (1) to (4), further including:

a second sensor (the liquid sensor 16, the CDC 56) configured to output an electrostatic capacitance between a first metal plate (the metal plate 74) disposed in a vicinity of the second load and a second metal plate (the metal plate 75) facing the first metal plate or between the first metal plate and a first ground surface; and a third sensor (the liquid sensor 16, the CDC 56) configured to output an electrostatic capacitance between a third metal plate (the metal plate 74) and a fourth metal plate (the metal plate 75) facing the third metal plate or between the third metal plate and a second ground surface, the third metal plate and the forth metal plate or the third metal plate and the second ground surface being provided in a space through which the conductive portion passes or provided so as to sandwich the space through which the conductive portion passes, in which the processing device detects the adhesion of the liquid based on an output of the second sensor and detects the entry of the liquid based on an output of the third sensor.

According to (11), both the adhesion and the entry of the liquid can be detected by the second sensor and the third sensor, and the safety of the aerosol inhaler can be further improved.

(12) The power supply unit according to any one of (7) to (10), in which the power supply, the processing device, the circuit board, and the second load are housed in a power supply unit case (the power supply unit case 11), in which the power supply unit case is configured such that an aerosol source unit (the first cartridge 20) including the aerosol source and the first load is attachable and detachable, and in which the first metal plate and the second metal plate or the first metal plate and the first ground surface are provided in the power supply unit case.

According to (12), since a capacitor or a pseudo capacitor is provided in the power supply unit case, a cost of the aerosol source unit that is frequently replaced with a new product can be reduced.

(13) The power supply unit according to any one of (7) to (10), in which the power supply, the processing device, and the circuit board are housed in a power supply unit case (the power supply unit case 11), in which the power supply unit case is configured such that an aerosol source unit (the first cartridge 20) is attachable and detachable, the aerosol source unit including the aerosol source, the first load, and the second load, the aerosol source unit being configured such that a flavor source unit (the second cartridge 30) including the flavor source is attachable and detachable, and in which the first metal plate and the second metal plate or the first metal plate and the first ground surface are provided in the aerosol source unit.

According to (13), since the capacitor or the pseudo capacitor can be provided in the vicinity of the second load, it is possible to improve detection accuracy for the adhesion or the entry of the liquid.

(14) The power supply unit according to any one of (7) to (13), further including:

an opening (the first opening K1 to the third opening K3) connecting an inside and an outside of the power supply unit;

a fifth metal plate disposed in a vicinity of the opening;

a sixth metal plate or a third ground surface facing the fifth metal plate; and a fourth sensor (the submersion sensor 17) configured to output an electrostatic capacitance between the fifth metal plate and the sixth metal plate or between the fifth metal plate and the third ground surface, in which the processing device detects entry of water into the aerosol inhaler based on an output of the fourth sensor, in which when the adhesion of the liquid or the entry of the liquid is detected, the processing device executes the first fail-safe action, and in which when entry of the water is detected, the processing device executes a second fail-safe action different from the first fail-safe action.

According to (14), the entry of the water into the power supply unit is detected separately from the adhesion or the entry of the liquid, and when the entry of the water is detected, the fail-safe action different from that when the adhesion or the entry of the liquid is detected is executed. Accordingly, an appropriate fail-safe action can be executed for each abnormality that occurs.

(15) The power supply unit according to (14), in which the flavor source constitutes a flavor source unit (the second cartridge 30) together with an inhale port (the inhale port 32) to which a user puts a mouth, and in which only the first metal plate of the first metal plate and the fifth metal plate is provided in a vicinity of the second load.

According to (15), since the first metal plate for detecting the adhesion or the entry of the liquid is provided close to the inhale port and the fifth metal plate for detecting the entry of the water is not provided, it is difficult to erroneously recognize the adhesion or the entry of the liquid and the entry of the water. Therefore, an appropriate fail-safe action can be executed for each abnormality that occurs.

(16) An aerosol inhaler (the aerosol inhaler 1) that causes an aerosol generated from an aerosol source (the aerosol source 22) to pass through a flavor source (the flavor source 33) to add a flavor component of the flavor source to the aerosol, the aerosol inhaler including:

a flavor source unit (the second cartridge 30) including the flavor source;

an aerosol source unit (the first cartridge 20) including the aerosol source and a first load (the first load 21) configured to heat the aerosol source; and a power supply unit (the power supply unit 10) configured such that the flavor source unit and the aerosol source unit are attachable and detachable, in which the power supply unit includes:

a second load (the second load 31) configured to heat the flavor source, a power supply (the power supply 12) dischargeable to the first load and dischargeable to the second load, a notification unit (the notification unit 45), a processing device (the MCU 50), a circuit board (the circuit board 13) on which the processing device is mounted, and a conductive portion (the conductive portion 71) configured to electrically connect the second load and the circuit board, in which the processing device is configured to detect adhesion of a liquid to the second load or entry of the liquid into the conductive portion, and in which when the adhesion or the entry is detected, the processing device executes at least one of a notification action that causes the notification unit to execute a notification and a first fail-safe action including prevention of discharging from the power supply to the second load.

According to (16), it is possible to detect the adhesion of the liquid formed by the aggregation of the aerosol to the second load, or the entry of the liquid into the conductive portion. Further, when the adhesion or the entry of the liquid is detected, the notification action and/or the first fail-safe action are/is executed, so that the safety of the aerosol inhaler is improved.

(17) An aerosol inhaler (the aerosol inhaler 1) that causes an aerosol generated from an aerosol source (the aerosol source 22) to pass through a flavor source (the flavor source 33) to add a flavor component of the flavor source to the aerosol, the aerosol inhaler including:

a flavor source unit (the second cartridge 30) including the flavor source;

an aerosol source unit (the first cartridge 20) including the aerosol source, a first load (the first load 21) configured to heat the aerosol source, and a second load (the second load 31) configured to heat the flavor source, and configured such that the flavor source unit is attachable and detachable; and a power supply unit (the power supply unit 10) configured such that the aerosol source unit is attachable and detachable, in which the power supply unit includes:

a power supply (the power supply 12) dischargeable to the first load and dischargeable to the second load, a notification unit (the notification unit 45), a processing device (the MCU 50), a circuit board (the circuit board 13) on which the processing device is mounted, and a conductive portion (the conductive portion 71) configured to electrically connect the second load and the circuit board, in which the processing device is configured to detect adhesion of a liquid to the second load or entry of the liquid into the conductive portion, and in which when the adhesion or the entry is detected, the processing device executes at least one of a notification action that causes the notification unit to execute a notification and a first fail-safe action including prevention of discharging from the power supply to the second load.

According to (17), it is possible to detect the adhesion of the liquid formed by the aggregation of the aerosol to the second load, or the entry of the liquid into the conductive portion. Further, when the adhesion or the entry of the liquid is detected, the notification action and/or the first fail-safe action are/is executed, so that the safety of the aerosol inhaler is improved.

What is claimed is:

1. A power supply unit for an aerosol inhaler that causes an aerosol generated from an aerosol source to pass through a flavor source to add a flavor component of the flavor source to the aerosol, the power supply unit comprising:

a power supply dischargeable to a first load configured to heat the aerosol source and dischargeable to a second load configured to heat the flavor source;

a notification unit;

a processing device;

a circuit board on which the processing device is mounted; and a conductive portion configured to electrically connect the second load and the circuit board, wherein the processing device is configured to detect adhesion of a liquid to the second load or entry of the liquid into the conductive portion, and wherein when the adhesion or the entry is detected, the processing device executes at least one of a notification action that causes the notification unit to execute a notification and a first fail-safe action including prevention of discharging from the power supply to the second load.

2. The power supply unit according to claim 1, wherein the first fail-safe action further includes prevention of discharging from the power supply to the first load.

3. The power supply unit according to claim 1, wherein an auxiliary storage portion configured to store the liquid is provided in a vicinity of the second load.

4. The power supply unit according to claim 1, further comprising:

an inhale sensor configured to output a value related to inhale of a user, wherein the processing device detects a start of the inhale and an end of the inhale based on an output of the inhale sensor, wherein the processing device starts discharging to the first load in response to the start of the inhale, wherein when any one of an elapse of a predetermined time since the start of the inhale or a start of discharging to the first load and the end of the inhale is detected, the processing device stops discharging to the first load, wherein the processing device is configured to control power discharged to the first load, and wherein the processing device shortens the predetermined time as power discharged to the first load increases.

5. The power supply unit according to claim 1, further comprising:

a first sensor configured to output a value related to an electric resistance value of the second load, wherein the processing device detects the adhesion of the liquid based on an output of the first sensor.

6. The power supply unit according to claim 5, wherein an electric resistance value of the second load has a correlation with a temperature of the second load, and wherein the processing device controls discharging from the power supply to the second load based on an output of the first sensor such that a temperature of the second load converges to a target temperature.

7. The power supply unit according to claim 1, further comprising:

a second sensor configured to output an electrostatic capacitance between a first metal plate disposed in a vicinity of the second load and a second metal plate facing the first metal plate or between the first metal plate and a first ground surface, wherein the processing device detects the adhesion of the liquid or the entry of the liquid based on an output of the second sensor.

8. The power supply unit according to claim 7, wherein an auxiliary storage portion configured to store the liquid is provided in a vicinity of the second load, wherein the first metal plate and the second metal plate or the first metal plate and the first ground surface are arranged inside, at an end portion, or in a vicinity of the auxiliary storage portion, and wherein the processing device detects the adhesion of the liquid based on an output of the second sensor.

9. The power supply unit according to claim 8, wherein a porous body is provided between the first metal plate and the second metal plate or between the first metal plate and the first ground surface.

10. The power supply unit according to claim 7, wherein the first metal plate and the second metal plate or the first metal plate and the first ground surface are provided in a space through which the conductive portion passes or are provided so as to sandwich the space through which the conductive portion passes, and wherein the processing device detects the entry of the liquid based on an output of the second sensor.

11. The power supply unit according to claim 1, further comprising:

a second sensor configured to output an electrostatic capacitance between a first metal plate disposed in a vicinity of the second load and a second metal plate facing the first metal plate or between the first metal plate and a first ground surface; and a third sensor configured to output an electrostatic capacitance between a third metal plate and a fourth metal plate facing the third metal plate or between the third metal plate and a second ground surface, the third metal plate and the forth metal plate or the third metal plate and the second ground surface being provided in a space through which the conductive portion passes or provided so as to sandwich the space through which the conductive portion passes, wherein the processing device detects the adhesion of the liquid based on an output of the second sensor and detects the entry of the liquid based on an output of the third sensor.

12. The power supply unit according to claim 7, wherein the power supply, the processing device, the circuit board, and the second load are housed in a power supply unit case, wherein the power supply unit case is configured such that an aerosol source unit including the aerosol source and the first load is attachable and detachable, and wherein the first metal plate and the second metal plate or the first metal plate and the first ground surface are provided in the power supply unit case.

13. The power supply unit according to claim 7, wherein the power supply, the processing device, and the circuit board are housed in a power supply unit case, wherein the power supply unit case is configured such that an aerosol source unit is attachable and detachable, the aerosol source unit including the aerosol source, the first load, and the second load, the aerosol source unit being configured such that a flavor source unit including the flavor source is attachable and detachable, and wherein the first metal plate and the second metal plate or the first metal plate and the first ground surface are provided in the aerosol source unit.

14. The power supply unit according to claim 7, further comprising:

an opening connecting an inside and an outside of the power supply unit;

a fifth metal plate disposed in a vicinity of the opening;

a sixth metal plate or a third ground surface facing the fifth metal plate; and a fourth sensor configured to output an electrostatic capacitance between the fifth metal plate and the sixth metal plate or between the fifth metal plate and the third ground surface, wherein the processing device detects entry of water into the aerosol inhaler based on an output of the fourth sensor, wherein when the adhesion of the liquid or the entry of the liquid is detected, the processing device executes the first fail-safe action, and wherein when entry of the water is detected, the processing device executes a second fail-safe action different from the first fail-safe action.

15. The power supply unit according to claim 14, wherein the flavor source constitutes a flavor source unit together with an inhale port to which a user puts a mouth, and wherein only the first metal plate of the first metal plate and the fifth metal plate is provided in a vicinity of the second load.

16. An aerosol inhaler that causes an aerosol generated from an aerosol source to pass through a flavor source to add a flavor component of the flavor source to the aerosol, the aerosol inhaler comprising:

a flavor source unit including the flavor source;

an aerosol source unit including the aerosol source and a first load configured to heat the aerosol source; and a power supply unit configured such that the flavor source unit and the aerosol source unit are attachable and detachable, wherein the power supply unit includes:

a second load configured to heat the flavor source, a power supply dischargeable to the first load and dischargeable to the second load, a notification unit, a processing device, a circuit board on which the processing device is mounted, and a conductive portion configured to electrically connect the second load and the circuit board, wherein the processing device is configured to detect adhesion of a liquid to the second load or entry of the liquid into the conductive portion, and wherein when the adhesion or the entry is detected, the processing device executes at least one of a notification action that causes the notification unit to execute a notification and a first fail-safe action including prevention of discharging from the power supply to the second load.

17. An aerosol inhaler that causes an aerosol generated from an aerosol source to pass through a flavor source to add a flavor component of the flavor source to the aerosol, the aerosol inhaler comprising:

a flavor source unit including the flavor source;

an aerosol source unit including the aerosol source, a first load configured to heat the aerosol source, and a second load configured to heat the flavor source, and configured such that the flavor source unit is attachable and detachable; and a power supply unit configured such that the aerosol source unit is attachable and detachable, wherein the power supply unit includes:

a power supply dischargeable to the first load and dischargeable to the second load, a notification unit, a processing device, a circuit board on which the processing device is mounted, and a conductive portion configured to electrically connect the second load and the circuit board, wherein the processing device is configured to detect adhesion of a liquid to the second load or entry of the liquid into the conductive portion, and wherein when the adhesion or the entry is detected, the processing device executes at least one of a notification action that causes the notification unit to execute a notification and a first fail-safe action including prevention of discharging from the power supply to the second load.

* * * * *